US005105614A

United States Patent [19]

Briner et al.

[11] Patent Number: 5,105,614

[45] Date of Patent: Apr. 21, 1992

[54] METHOD AND APPARATUS FOR SUPPLYING RESERVE FEED STOCK TO A SPINNING MACHINE

[75] Inventors: Emil Briner, Winterthur; Isidor Fritschi, Andelfingen, both of Switzerland

[73] Assignee: Maschinenfabrik Rieter AG, Winterthur, Switzerland

[21] Appl. No.: 395,606

[22] Filed: Aug. 18, 1989

Related U.S. Application Data

[62] Division of Ser. No. 211,534, Jun. 24, 1988, abandoned.

[30] Foreign Application Priority Data

Jun. 24, 1987 [CH] Switzerland ..... 02377/87

[51] Int. Cl.[5] ..... D01H 4/48

[52] U.S. Cl. ..... 57/263; 57/90

[58] Field of Search ..... 57/90, 261, 263, 408, 57/409, 412, 91; 19/157, 150, 159 A

[56] References Cited

U.S. PATENT DOCUMENTS

| | | | |
|---|---|---|---|
| 2,608,725 | 9/1952 | Strew | 19/157 |
| 4,033,104 | 7/1977 | Kamp | 57/90 X |
| 4,096,686 | 6/1978 | Stahlecker et al. | 57/412 |
| 4,150,534 | 4/1979 | Raasch | 19/159 A X |
| 4,195,388 | 4/1980 | Bulla | 19/157 |
| 4,224,719 | 9/1980 | Bulla | 19/157 |
| 4,653,263 | 3/1987 | Stahlecker et al. | 57/263 |
| 4,838,018 | 6/1989 | Hoeber | 57/409 |

FOREIGN PATENT DOCUMENTS

| | | | |
|---|---|---|---|
| 2230644 | 12/1972 | Fed. Rep. of Germany | 19/157 |
| 2739 | 2/1966 | Japan | 19/157 |
| 135792 | 2/1960 | U.S.S.R. | 19/157 |

*Primary Examiner*—Joseph J. Hail, III

*Attorney, Agent, or Firm*—Sandler, Greenblum & Bernstein

[57] ABSTRACT

The method and apparatus for supplying a reserve feed stock to a spinning machine or spinning position thereof, contemplates monitoring the operational state of a production feed stock and upon reaching a predeterminate operational state thereof, such as near depletion or depletion of the production feed stock, or even rupture thereof, bringing a reserve feed stock previously held in readiness into a production position where such reserve feed stock now assumes the role of a production feed stock. In this way, downtime of the spinning machine or spinning position can be minimized and its operation at least partially automated insofar as there is always available a reserve feed stock to allow for essentially continuous or continual production of a spun yarn or thread.

12 Claims, 10 Drawing Sheets

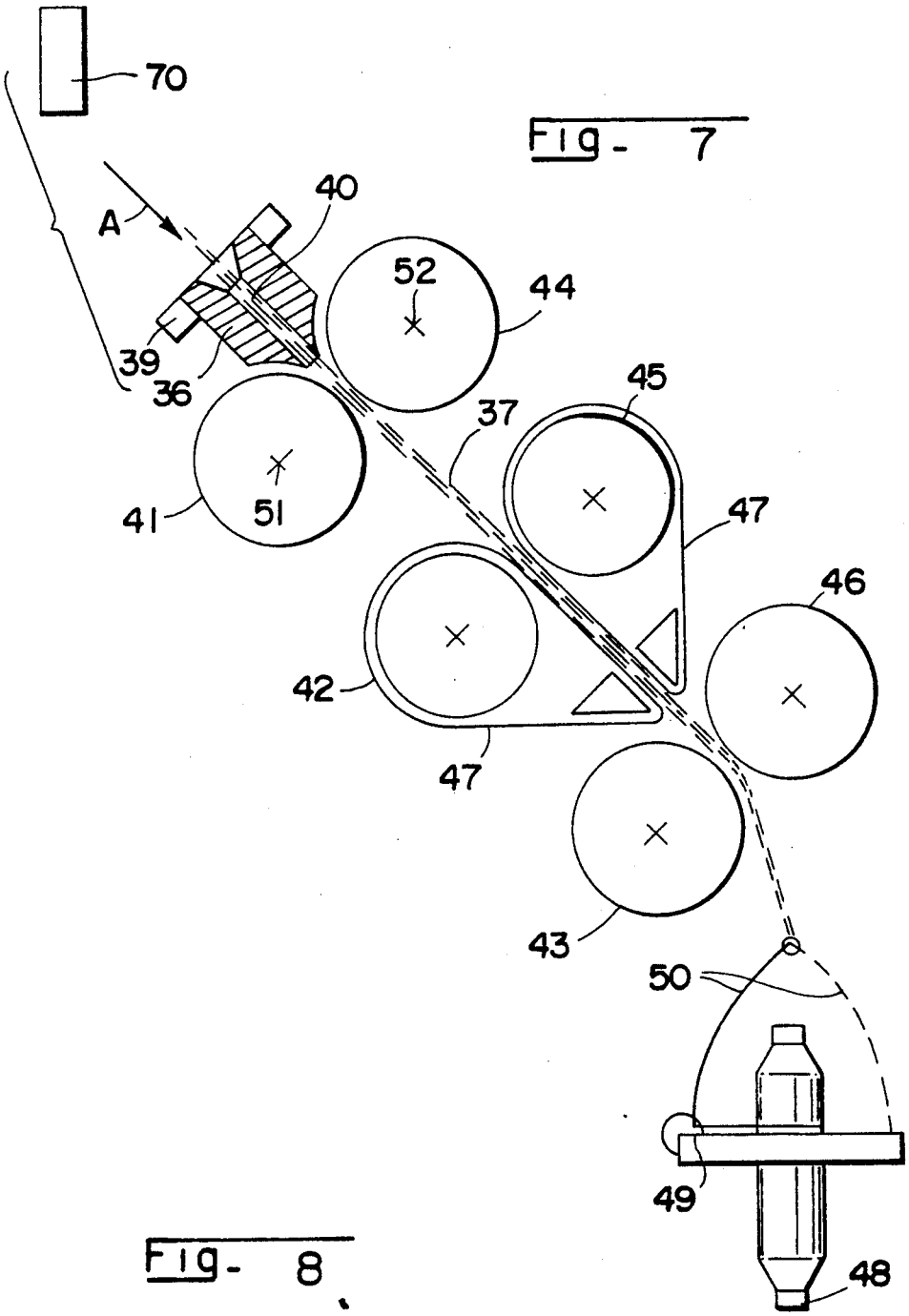
Fig- 7
Fig- 8
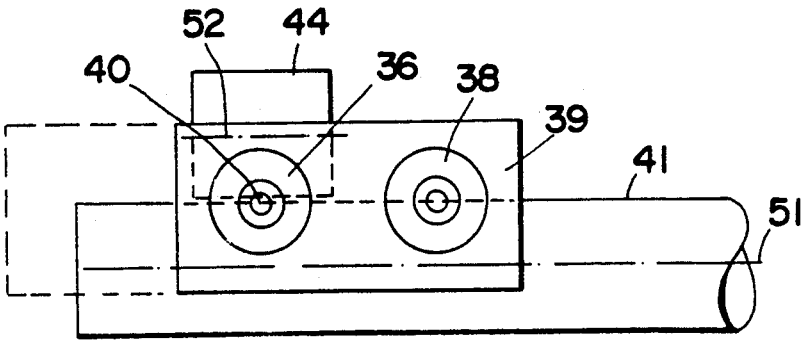

METHOD AND APPARATUS FOR SUPPLYING RESERVE FEED STOCK TO A SPINNING MACHINE

CROSS REFERENCE TO RELATED APPLICATIONS

This application is a divisional application of the commonly assigned, copending U.S. application Ser. No. 07/211,534, filed Jun. 24, 1988, and entitled "METHOD AND APPARATUS FOR SUPPLYING RESERVE FEED STOCK TO A SPINNING MACHINE", now abandoned, and is also related to the commonly assigned, copending U.S. application Ser. No. 07/456,156, filed Dec. 22, 1989, now U.S. Pat. No. 4.970,855, issued on Nov. 20, 1990, and entitled "METHOD AND APPARATUS FOR PIECING A RESERVE FEED STOCK WITH A PRODUCTION FEED STOCK" and the commonly assigned, copending U.S. application Ser. No. 07/426,281, filed Oct. 25, 1989, and now U.S. Pat. No. 4,964,267, issued on Oct. 23, 1990 and entitled "METHOD AND APPARATUS FOR PIECING A RESERVE FEED STOCK WITH A PRODUCTION FEED STOCK".

BACKGROUND OF THE INVENTION

The present invention broadly relates to textile machines and, more particularly, to a spinning machine having one or more spinning positions or locations and serving for producing threads or yarns from staple fiber feed stock or fiber material.

Generally speaking, according to a first aspect of the present invention, there is provided a spinning machine for producing threads or yarns from drawable or draftable staple fiber feed stock in which the feed stock passes from feed stock or fiber material supplies to spinning assemblies or positions, each of the spinning assemblies comprising, for instance, a feed member, a drafting member and a twist imparting member. The present invention is also concerned with a method of feeding feed stock or fiber material to a spinning position or location of a spinning machine.

According to a second aspect of the present invention, there is provided a new and improved method of, and apparatus for, piecing or joining a reserve or spare feed stock or mass of fiber material, such as a reserve or spare roving, to a production feed stock or mass of fiber material, such as a production roving on textile machines, especially, by way of example and not limitation, a ring spinning machine.

As to the aforementioned first aspect of the present invention concerning feed stock supply, it is noted that currently known spinning machines of this type have the disadvantage that when the feed stock (which can be fiber sliver removed from a can or roving delivered from a bobbin) is depleted or exhausted, the provision of a new feed stock supply, i.e. a full can or a full bobbin, and the insertion of the fiber sliver or the roving into the spinning position is time-consuming. The downtime of the spinning position or of the complete spinning machine which accordingly results is responsible for considerable costs and impairs the efficiency and economy of the manufacturing operation. Downtime could be eliminated to a certain degree by ensuring presence of attendant personnel or operators available at any time to carry out a change at the instant of indication that the feed stock or fiber supply had been exhausted. However, this would also cause high fabrication costs. Further, manual piecing or joining of the feed stocks, as at present carried out, is frequently undesirable for quality reasons, since such piecing operation is almost always associated with a yarn or thread break or a thick place in the yarn or thread. This is particularly the case in relation to processing methods in which the yarn packages are woven or knitted, without further back winding operations, directly upon the loom or the knitting machines.

As to the secondary piecing or joining aspect of the invention, it is noted that with ring spinning machines, empty roving bobbins have to be replaced by full ones. When the bobbins are changed at random there is the necessity for an operator to stop the spindle, to pull off the end of the roving from the new or reserve bobbin and to insert this end into the drafting mechanism or arrangement, to wait a certain time until this end of the roving has gone through the drafting mechanism or arrangement, to again place the spindle into operation or rotation, then to piece or join up the end of the yarn of the reserve bobbin with the yarn of the spindle, to speed up the spindle again and to search for further empty roving bobbins. With simultaneous or batch or group changing of the bobbins, the operator usually tears the production roving and pieces or joins or fuses the end with the new or reserve roving. Also, this requires a high concentration on the part of the operator during a short time interval.

SUMMARY OF THE INVENTION

Therefore with the foregoing in mind it is a primary object of the present invention to provide a new and improved construction of a spinning machine producing threads or yarns or the like from staple fiber feed stock and a method of operating the same in a manner which is not afflicted with the aforementioned drawbacks and shortcomings of the prior art.

Yet a further significant object of the present invention aims at providing a new and improved construction of a spinning machine producing threads or yarns from staple fiber feed stock and which is relatively simple in construction and design, quite economical to manufacture, highly reliable in operation, not readily subject to breakdown or malfunction, requires a minimum of maintenance and servicing, and affords enhanced efficiency and economy in the production of the threads or yarns or the like.

Another noteworthy object of the present invention is concerned with a new and improved method of, and apparatus for, making available in a highly efficient and reliable fashion, a reserve or spare feed stock for a textile machine upon depletion of a production feed stock.

Now in order to implement these and still further objects of the invention, which will become more readily apparent as the description proceeds, and in keeping with the first feed stock supply aspect of the present invention, the spinning machine producing yarns from drawable or draftable staple fiber feed stock in which the feed stock passes from feed stock or fiber supplies to spinning assemblies is, among other things, manifested by the features that there are at least temporarily or currently provided for each spinning assembly a production feed stock and a stand-by or reserve feed stock. Two feed members are provided for feeding each of the feed stocks. The feed member serving for feed of the production feed stock is located in an operating position and the feed member serving for feed of the stand-by or reserve feed stock is located in a stand-by or reserve position. There are also provided means for changing the feed members between the operating and stand-by positions in dependence upon a predeterminate operating state, such as the presence of a feed stock running from a production feed stock package or supply to the feed member located in the operating position.

As already noted, the first aspect of the invention concerning feed stock supply is not only concerned with the aforementioned apparatus features, but also concerns a method of feeding fiber material or feed stock to a spinning assembly or position which comprises the steps of connecting a plurality of feed stock supplies to an associated infeed and switching from one to the other of the feed stock supplies as the one feed stock supply, for instance, reaches or approaches depletion or exhaustion.

This first aspect of the present invention makes it possible to ensure that when the feed stock at the spinning machine or assembly or spinning position or location is exhausted or near exhaustion or depletion, an automatic insertion of a reserve or stand-by feed stock into the spinning process is effected without noticeable time delay so that the spinning machine or the like, can continue processing without significant loss of time, i.e. immediately after the automatic device or switch structure provided for this purpose has carried out the insertion of the reserve or spare supply. This loss of time, for instance, corresponds to the order of magnitude of the time required for automatic attendance to a thread or yarn break in known spinning machines. A great deal of time is available for the subsequent manual or mechanical exchange of the empty supply, namely the period of time prevailing until the reserve or spare supply incorporated into the yarn or thread production has itself become empty or depleted. This is particularly valuable, for instance, in the case of automatic or automated machines because then only very few attendants or operators are required. Thus, this mode of operation permits, for example, carrying out of long, low attendance night shifts during which the attendant personnel only has to essentially perform monitoring functions, i.e. is not required to perform any direct intervention in the operating process.

The various aspects of the present invention are chiefly advantageous in spinning operations performed on the basis of a ring spinning machine, rotor and friction processes and air jet spinning. This is particularly so for the feed stock supply aspects, whereas the piecing aspects are especially useful in conjunction with ring spinning.

German Patent No. 2,614,182, published Mar. 28, 1985, discloses a feed device for open-end spinning assemblies in which an infeed trumpet is moveable by means of a sliding rod and in this manner can be moved back from a position in front of a feed roll, in which it is located in its operating position, through an opening, and then can be moved back through this opening into its operating position. This is carried for the purpose of facilitating threading into the trumpet. There is no conceptual link with the present invention.

German Published Patent Application No. 2,513,692, published Oct. 23, 1975, and Swiss Patent No. 562,337, granted Apr. 15, 1975, relate to an open-end spinning device in which two or more fiber slivers are fed simultaneously to an opening roller from several trumpets (condensers) for the purpose of blending the fibers of several slivers. These patent publications also exhibit no significant concept in common with the present invention.

According to the second aspect of the present invention dealing with feed stock piecing or joining, there is provided a method of piecing or joining a reserve or spare roving to a production roving on textile machines, especially, for instance, a ring spinning machine, wherein a production roving is brought into an operating position. According to this second method aspect of the present invention, in a first step, the reserve or spare roving is brought into a reserve or stand-by position, and in a second step, an increasing twisting force is imparted to a first roving section of both rovings, thus causing a substantially parallel orientation of the fibers in a second roving section adjacent to the first roving section of each of the rovings. Then in a third step, both rovings are separated or severed in the second roving section of both rovings, and in a fourth step, the increasing twisting force is suddenly removed, causing end sections of both rovings to decrease their twist and simultaneously both roving end sections are brought together by virtue of which they piece or join or fuse to one another. In a fifth step, the reserve or spare roving is brought into the operating position.

As to the apparatus aspects for performing such piecing method, such are manifested, among other things, by the features that there are provided a first part or body portion, such as a lower part having two roving exit channels and a second part or body portion, such as an upper part having two roving intake channels. The upper part is rotatable over the surface of the lower part and all channels lead into an intersection zone positioned, for instance, in the lower part. A roving twisting means is provided for one intake channel for the reserve or spare roving as well as a roving twisting means is provided for the exit channel positioned opposite the one intake channel and which is provided for the production roving. There is also provided a roving severing means for the other intake channel as well as a roving severing means for the exit channel positioned opposite the other intake channel.

In case the insertion of the reserve or spare roving is executed manually, there will be available a long time for carrying out such activity, so that peak work loads should not occur. No other activities in conjunction with the piecing or joining of the reserve or spare roving have to be carried out by the operating personnel or attendants. By increasing the twisting or twist in the roving ends to be pieced or joined, a reliable piecing operation is ensured. The piecing apparatus or device contains only few parts, having a favorable affect on the manufacturing costs thereof.

Although the use of mechanical roving twisting means are conceivable, it is possible to use only air for the increased twisting or twist as well as for the separation or severing operation. It is advantageous when the production roving is automatically monitored instead of such production roving being monitored by the operating personnel. In this regard, upon reaching a predeterminate state thereof, for instance, a minimum supply thereof, a signal is emitted to initiate the aforementioned method steps starting with the second step of increasing the twisting force.

In connection with roving piecing, the invention also contemplates the provision of a closeable air exit in or for the intersection zone. This ensures that consumed or used air can escape even faster.

The second piecing aspect of the invention also contemplates the possible provision of an air suction nozzle in the exit channel for the reserve or spare roving. Thus, on the one hand, the end of the reserve or spare roving can be held and, on the other hand, the severed reserve roving part can be removed immediately without the danger of causing damage of any kind.

Again in terms of the piecing or joining aspect of the invention, there is again contemplated a different method and apparatus for piecing or joining a reserve or spare feed stock, such as a reserve or spare roving, to a production feed stock, such as a production roving. With such further piecing method there is accomplished during a first step, bringing a reserve or spare roving into a reserve or stand-by or preparatory position, and during a second step, bringing an end portion or section of the reserve or spare roving into a predeterminate path of travel of a production roving. During such second step, there is pressed the end portion or section of the reserve or spare roving against a first portion or section of the production roving and substantially at the same time, there is separated or severed the production roving. During a third step, there is brought a second portion or section of the reserve or spare roving, which bounds the end portion or section of the reserve or spare roving, into the predeterminate path of travel of the production roving.

In keeping with the immediately preceding method aspects, the invention further contemplates a piecing or joining apparatus or device for accomplishing such method. Here, the apparatus for such piecing or joining of a reserve or spare roving to a production roving at or on a textile machine, especially a ring spinning machine, comprises a drafting mechanism possessing a pair of infeed rolls, and a housing provided with an elongate hole which is bounded by an upper end or portion which determines or defines a predeterminate path of travel of the production roving. A movable member, such as a slide plate is arranged at a lower region or portion of the elongate hole and this slide plate is displaceable substantially perpendicular to the upper end or portion of the elongate hole. The slide plate serves for the reception and displacement of the reserve or spare roving. An open lengthwise slot opens into the elongate hole, and the housing has a housing portion situated opposite to the pair of infeed rolls. This housing portion comprises a press-on or pressing region and the housing has a further housing portion facing away from the pair of infeed rolls. This further housing portion defines a separation region for the production roving. There is also provided a separation body for the separation of the production roving and which is located in or at the separation region. This separation body coacts with the slide plate.

In the event that insertion of the reserve or spare roving is to be carried out manually, then a great deal of time is available for this activity, with the beneficial result that no peak work loads should arise. The operator or attendant personnel need not perform any further operations with respect to the piecing or joining of the reserve or spare roving. There is thus afforded reliable operation by virtue of the simultaneous pressing of the reserve or spare roving against the production roving and the separation, that is to say, the clamping or severing, of the production roving at another section or region. This apparatus also contains only very few parts which enhances the economies of the equipment.

Without the need to resort to additional equipment or devices, it is possible for the second portion or section of the reserve or spare roving to be brought into the path of the production roving simply by exploiting the drafting mechanism in that, the second portion or section of the reserve or spare roving is brought into the travel path of the production roving by pulling taut or tensioning the reserve or spare roving.

According to a further piecing aspect of this part of the invention, it is contemplated to design the piecing apparatus or device such that the distance between the press-on or pressing region and the clamping region is greater than the mean or average fiber length of the fibers of the production roving, and the distance between the clamping point of the pair of infeed rolls and the press-on or pressing region is smaller than one-half of the mean or average fiber length. By virtue of these measures, the functional reliability of such piecing method and apparatus can be significantly increased.

An additional increase in the functional reliability of the method and apparatus is achieved in that the elongate hole possesses a greater depth at least in the distance or spacing region between the clamping region and the press-on or pressing region. According to a further feature, there is provided a removable spacer or distance element at the press-on or pressing region. Consequently, the production roving and the reserve or spare roving in the stand-by or reserve or preparatory position, can be arranged without hindering each other.

The removable spacer or distance element can be structured as holding means for the reserve or spare roving. With that design, it is possible to advantageously reduce the number of components of the piecing or joining apparatus or device.

It is also within the teachings of the piecing method of the invention, and the apparatus for practising the same, to simply allow the terminal or finishing end of the production roving to run-out, without separation of the production roving, and to bring the reserve or stand-by roving into pressing contact with a defined terminal or finishing end portion of the production roving for piecing or joining of the reserve and production rovings to one another.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein:

FIG. 7 is a schematic representation of a further embodiment of a spinning machine having a spinning assembly or position and constructed according to the present invention, here shown equipped with a drafting mechanism and employed for ring spinning;

FIG. 8 is an end view of the fiber stock feed mechanism of the arrangement of FIG. 7, viewed in the direction of the arrow A thereof;

DETAILED DESCRIPTION OF THE PREFERRED EMBODIMENTS

Describing now the drawings, it is to be understood that only enough of the construction and details of the exemplary embodiments of the present development have been depicted therein as needed for those skilled in the art to readily understand the underlying principles and concepts of the present invention. Initially, there will be considered various exemplary embodiments of the invention concerning providing a reserve or spare feed stock of fiber material for a textile machine which, following the attainment of a predeterminate operating condition or state, such as that the current production feed stock is, for instance, reaching a predeterminate state of depletion, or otherwise needs to be replaced by the reserve or spare feed stock, is shifted from its stand-by or reserve position into an operating position so that such reserve or spare feed stock now is beneficially used as production feed stock. It is also to be understood that in the context of this disclosure, the terms "thread" or "yarn" are used in their broader sense as denoting generally filamentary material or the like produced by textile spinning machines.

Figure 2:
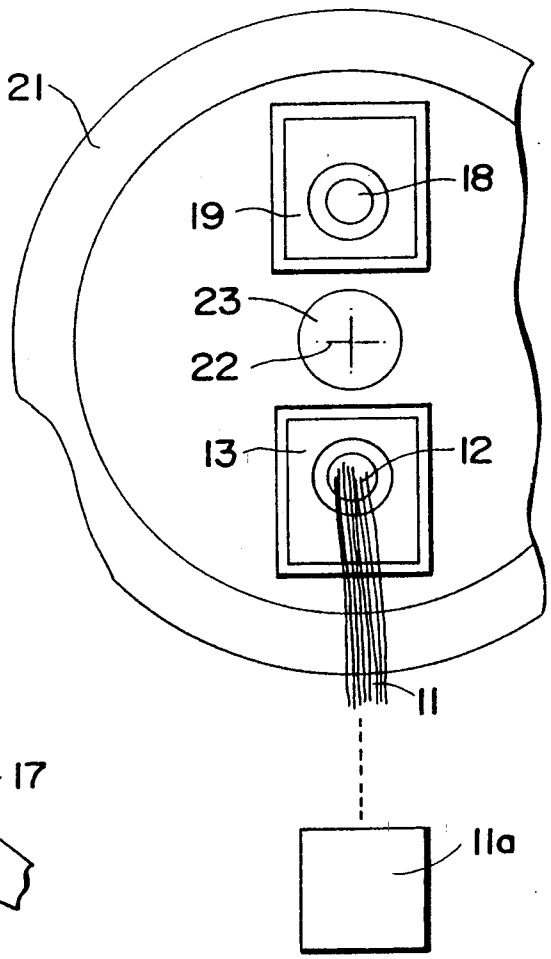
FIG. 2 is an end view of the spinning assembly or position depicted in FIG. 1 as viewed from the left side thereof.
Figure 1:
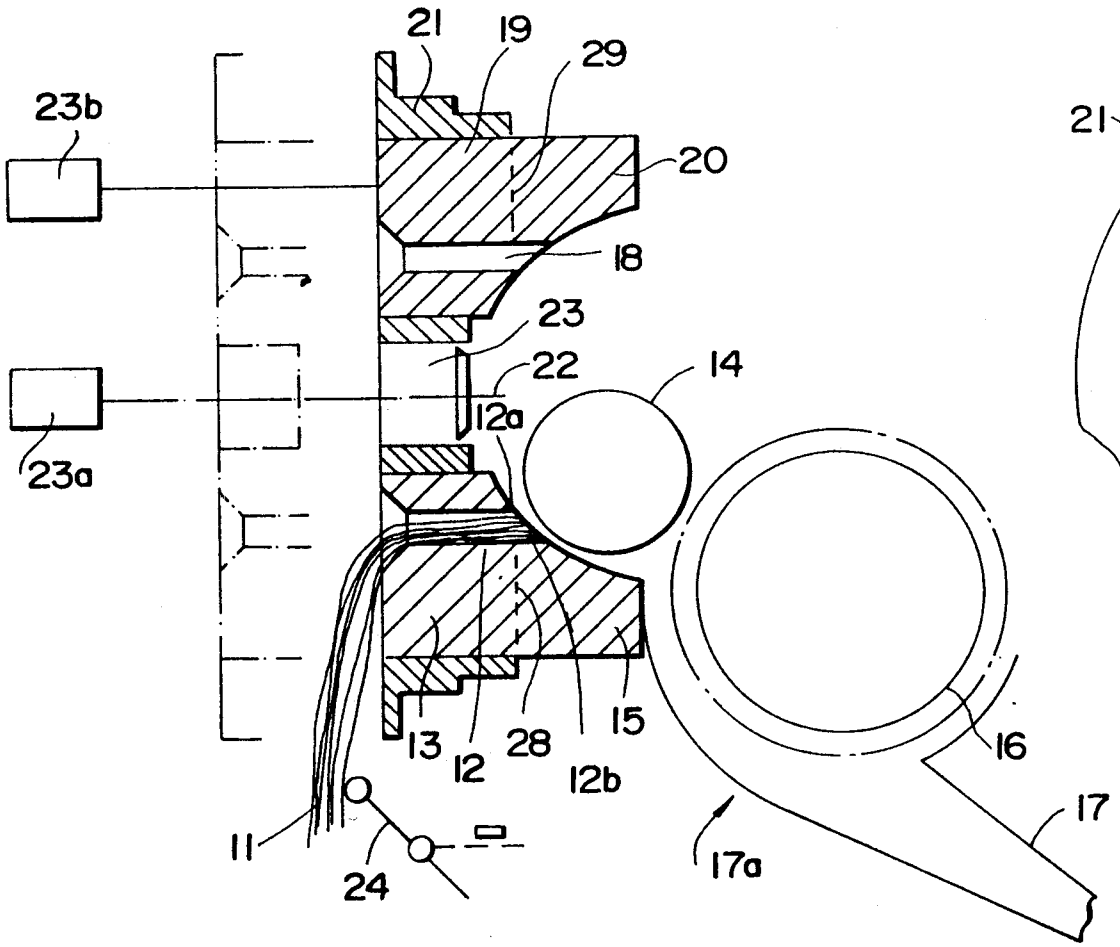
FIG. 1 is a cross-sectional view of an exemplary embodiment of a spinning machine having a spinning assembly or position and constructed in accordance with the invention.

Turning now specifically to FIGS. 1 and 2 of the drawings, a mass of fiber material, here a fiber sliver 11 forming a feed stock is fed through a first feed passage or duct 12 of a first feed member or element 13. The exit or departure point or region 12*a* of the feed passage or duct 12 is located in the immediate neighborhood of a feed roller or roll 14, i.e. immediately in front of a converging space 12*b* located before the feed roller or roll 14. The feed roller or roll 14 in conjunction with a first clamping member, here a clamping table 15, serves to transport the fiber sliver 11 to a downstream arranged suitable opening roller or roll 16 forming a drafting member. A fiber feed passage or duct 17 of the opening device 17*a* containing the opening roll 16, serves to transport the fibers separated by means of the opening roller 16 to a non-illustrated but conventional, twist imparting member or spinning rotor. At this point, it is noted that in the embodiment presently under discussion, the feed member 13 and the clamping table 15 form a rigid unit, although as will be subsequently explained this is not absolutely necessary.

Furthermore, there are provided a further or second feed member or element 19 provided with a second feed passage or duct 18, and a second clamping member, here again for instance, a clamping table 20. Within this feed passage or duct 18, there is retained a non-illustrated mass of fiber material, here a fiber sliver, forming a further feed stock. In the condition of operation depicted in FIG. 1, this further feed stock serves as a reserve or spare feed stock for use when the feed stock 11, currently or momentarily serving as production feed stock, has attained a predeterminate condition or state, such as being near or at exhaustion or depletion.

The feed member 19 and the associated clamping table 20, and equally the feed member 13 and the associated clamping table 15, are conjointly held together by a suitable holding or retention member, here shown as a substantially ring-shaped retention body or member 21. Furthermore, these feed members 13, 19 and clamping tables 15, 20 are supported by a shaft or shaft member 23 which is pivotable or turnable about the shaft axis 22. Pivoting of the shaft 23 can be accomplished by any suitable drive or drive means as generally indicated in FIG. 1 by reference character 23*a*. In FIGS. 1 and 2, and as noted previously, the feed member 13 is shown presently located in the operating position and the feed member 19 in the stand-by or reserve position. The explanations of these designations will become clear during the subsequent course of the description.

From what has been explained previously, it thus will be apparent that the unit 13, 15, namely the feed member 13 and its associated clamping table 15, and the unit 19, 20, namely the feed member 19 and its associated clamping table 20, are operatively secured to the pivotable shaft or shaft member 23. The pivotal movements of these units 13, 15 and 19, 20, are generated by appropriately driving the shaft 23 by means of the associated drive or drive means 23*a*. In the embodiment under discussion, the pivotal movements occur each time through an angle of essentially 180°, and during the course of such selective pivotal movements, each of the feed members 13 and 19 and their associated clamping tables 15 and 20, respectively, alternately arrive in the operating or stand-by positions, as the case may be. The fiber sliver 11, shown in FIG. 1 in the operating or production position and currently or momentarily constituting a production feed stock, is extracted from a non-illustrated production supply, such as a production can (merely schematically indicated in FIG. 2 by reference character 11*a*) containing fiber sliver, and is drawn through the feed member 13 which, as stated, is currently located in the operating position. In addition, a second non-illustrated fiber sliver, like the fiber sliver 11, delivered from a non-illustrated stand-by or reserve supply, such as a stand-by or reserve can (like the can 11*a*), is fed through the feed passage or duct 18 and is held therein in its reserve or stand-by or preparatory position.

A suitable monitoring member or means 24 serves for monitoring the fiber sliver 11, that is to say, to determine for instance, the presence thereof and, if desired, to generate a signal when, for instance, the fiber sliver 11 is lacking or depleted.

The aforedescribed units 13, 15 and 19, 20 are here also movable by any suitable and therefore merely schematically illustrated drive means 23*b* in directions substantially parallel to the shaft axis 22, for instance, to the left in accordance with the showing of FIG. 1, and thus these units 13, 15 and 19, 20 can be selectively withdrawn or retracted into the position indicated in chain-dotted lines, and can be again advanced or moved forward to the right of the showing of FIG. 1 back into the starting position illustrated with full or solid lines.

In operation of the spinning assembly or position, generally indicated by the elements designated with the reference numerals 12, 13, 14, 15 and 16, fiber sliver 11 is continuously moved between the feed roller or roll 14 and the associated clamping table or table member 15. As noted above, this fiber sliver 11 is extracted or withdrawn from the production supply or, here for instance sliver can 11*a*, and fed by the feed member 13 to the opening roller 16 serving as a drafting member. Thus, in the illustrated operating phase, the feed member 13 is presently located in the operating position. If the fiber sliver 11 of the production supply 11*a* is, for instance, sufficiently used up, then the monitoring member or means 24 delivers a signal, in response to which and during a first step the aforedescribed units 13, 15 and 19, 20 are withdrawn by the drive means 23*b* in a direction substantially parallel to the shaft axis 22, namely, to the left of the showing of FIG. 1. Thereafter, during a second step, the pivotable shaft 23 is pivoted or turned through 180° by the drive or drive means 23*a*. Finally, in a third step, these units 13, 15 and 19, 20 are moved forward again, under the action of the drive means 23*b*, substantially parallel to the shaft axis 22, namely to the right of the showing of FIG. 1, so that their positions are now mutually reversed with respect to their starting positions, as previously described.

Thus, the feed member 13 is now located in a stand-by or reserve or preparatory position and the other feed member 19 is now located in the operating position corresponding to the production position. Hence, if the prior production supply for the fiber sliver 11 is depleted or near depletion, then the fiber sliver held in the passage or duct 18 of the feed member 19, is automatically fed into the operating means, here the associated spinning assembly or position. Such prior reserve fiber sliver is removed from its fiber supply, which was previously the stand-by or reserve can, and which now, following the aforedescribed exchange or repositioning of the feed members 13 and 19, forms the production can. This new fiber sliver is entrained by the feed roll or roller 14 and fed to the opening roller or roll 16.

This exchange operation accomplished for the feed members 13 and 19 and their associated clamping tables 15 and 20, respectively, demands very little time, for instance, in the order of magnitude of the time required for automatically dealing with a thread or yarn break. The empty can, previously constituting the production can 11*a*, is now replaced by a full can when the opportunity arises, and the start of the fiber sliver of this full can is fed through the feed passage or duct 12 of the feed member 13, in order to be held therein. This full or second can now forms the stand-by or reserve can, since it will be recalled that the feed member 13 has now assumed the stand-by or reserve position. A great deal of time, for instance, of the order of several hours, is available for replacement of the empty can by a full one. When in the course of operation of the spinning machine the fiber supply can, now currently or momentarily constituting the production can, also becomes empty, then the described procedure is repeated. In the course of this repetition, the units or elements 12, 13, 15 and 18, 19, 20 again return to the positions illustrated in FIG. 1.

Figure 3:
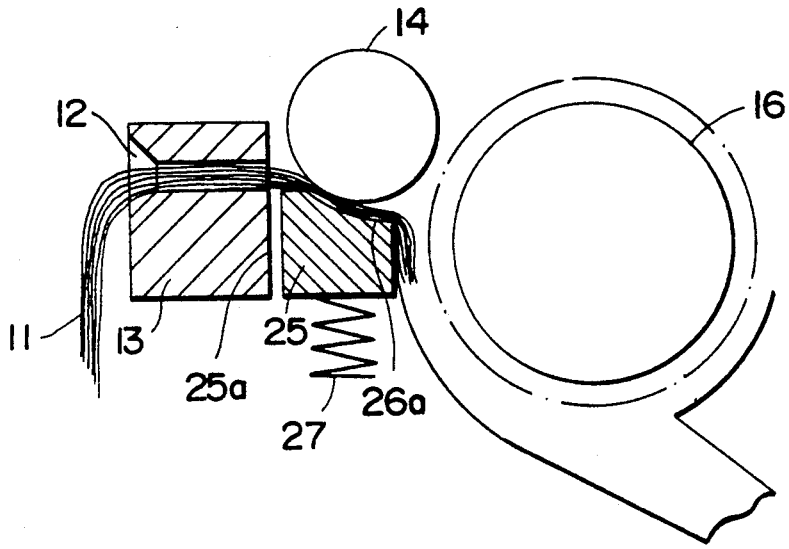
FIG. 3 is a cross-sectional view through a further exemplary embodiment of spinning assembly or position and constructed according to the present invention, the section being taken substantially along the line III—III of FIG. 4.
Figure 4:
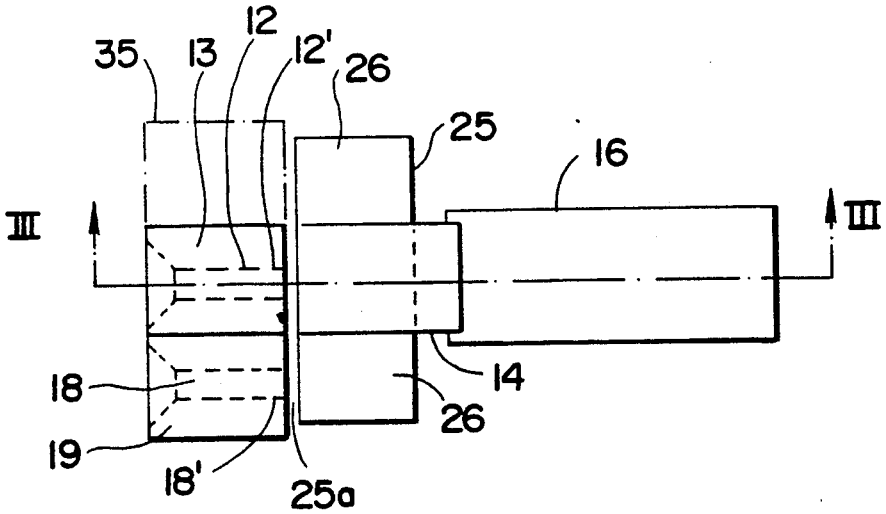
FIG. 4 is a top plan view of the embodiment of spinning assembly or position depicted in FIG. 3.

In accordance with the modified embodiment depicted in FIGS. 3 and 4, in which FIG. 3 is a section on the line III—III of FIG. 4, two feed members 13 and 19 are again provided. Each of these feed members 13 and 19 is provided with the associated feed passage or duct 12 and 18, respectively. The feed members 13 and 19 are, for instance, manufactured in one piece and are movable by means of any suitable drive, not here shown to simplify the illustration, substantially parallel to the side surfaces 25*a* of a clamping table 25. The feed member 13 is shown located in the operating position and thus the feed member 19 is currently or momentarily depicted in the stand-by or reserve or preparatory position. Hence, the feed member 13 receives fiber sliver 11 located in a production supply, for instance, as previously explained, and the feed member 19 receives fiber sliver located in a stand-by or reserve supply, likewise as previously explained. The feed members 13 and 19 are arranged immediately and with minimum intervening space at the confronting side surface 25*a* of the clamping table or member 25. This clamping table or member 25 has two infeed zones or regions 26 which advantageously are downwardly curved towards their free ends 26*a* to ensure guidance of fiber sliver ends hanging out of the exit or departure points or locations 12' and 18' of the feed passages or ducts 12 and 18, respectively.

A feed roller or roll 14 is located above the clamping table 25 and serves, in conjunction with such clamping table 25, to move the fiber sliver 11 (not illustrated in FIG. 4 but shown in FIG. 3) guided by the associated feed passage 12 to opening roller 16, for the purpose previously explained. By means of a resilient or elastic member, for example a spring 27, the clamping table 25 is biased or urged towards the associated feed roller 14. As in the embodiment of FIGS. 1 and 2 here also, in operation, the fiber sliver 11, currently or momentarily in the production mode or position, is separated into individual fibers by the opening roller 16 and these individual fibers are transported into a non-illustrated spinning unit such as a spinning rotor.

In operation, as soon as the fiber sliver 11 removed from the production supply has been, for instance, used up or near depletion, i.e. when a corresponding monitoring device, for instance like the monitoring member or means 24 of the arrangement of FIGS. 1 and 2, indicates the absence of such fiber sliver, then the feed members 13 and 19 are moved in such manner that now the feed member 19 passes into the operating position and the feed member 13 into the position 35 indicated in chain-dotted lines in FIG. 4, this latter position 35 being a stand-by or reserve position for the feed member 13. In this way, the fiber sliver held in readiness or reserve by the feed passage 18 and delivered by the stand-by or second can, possibly with the aid of a non-illustrated transporting device located within the associated feed member, is caught or entrained and the spinning process then continues after a short interruption. The original production supply, which is now empty, is replaced by a new feed stock supply and the fiber sliver present in this new feed stock supply is passed into the feed passage 12 of the feed member 13 and is held in readiness therein as a reserve or stand-by feed stock or fiber sliver supply. For the performance of these last two mentioned steps, a very long period of time is available which is again adequate for all practical requirements.

After the fiber sliver removed from the original stand-by or reserve can or other prior reserve or stand-by supply has been used up, then the feed members 13 and 19 are returned into their illustrated, original positions. After the second empty can has been replaced by a full one, the starting portion of the fiber sliver to be removed from the latter must be fed into the feed passage 18 and held therein again as a reserve or stand-by feed stock or fiber sliver supply.

In comparison with the embodiment of FIGS. 1 and 2, it should be apparent that in the modified embodiment of FIGS. 3 and 4 only a longitudinal or a substantially linear movement of the units or components 12, 13 and 18, 19 is necessary for accomplishing a fiber sliver change operation, while in the first described embodiment of FIGS. 1 and 2, a withdrawal or retraction and a pivotal movement and a return or forward movement of the units or components 13, 15 and 19, 20 takes place.

There is, however, afforded the possibility, by modifying the aforedescribed embodiment of FIGS. 1 and 2, to eliminate the withdrawal or retraction movement into the chain-dotted or phantom line position and the subsequent return or forward movement of the units or components 13, 15 and 19, 20. This can be achieved with a modified embodiment in which then the clamping table or member 15 is separated from the associated feed member 13 along the surface defined by the straight line 28 of FIG. 1 and in a direction normal to the plane of the drawing, i.e. a separate feed member 13 and clamping table 15 are provided, and in which case then the separate or autonomous clamping table or member 15 is now biased or urged towards the feed roller or roll 14 by a non-illustrated resilient or elastic means, for instance, like the spring 27 shown in FIG. 3. Furthermore, in such modified construction the clamping table or member 20 is likewise separated from the associated feed member 19 along the surface defined by the straight line 29 in FIG. 1 and in a direction normal to the plane of the drawing, and such clamping table or member 20 is no longer employed i.e. there is simply provided the feed member 19 without any clamping table 20. Under these conditions, piecing of a new fiber sliver necessitates only a pivotal movement of the units or components 12, 13 and 18, 19 through essentially 180°, and the aforedescribed withdrawal and return movements no longer are necessary.

It should be apparent that the initially described embodiment of FIGS. 1 and 2 employing the withdrawal and forward or return movements of the units or components 12, 13, 15 and 18, 19, 20, has the advantage that no gap or intervening space is present between the feed members 13 and 19 and the clamping tables 15 and 20, respectively. If such a gap or gaps were present, fibers could be undesirably caught therein. Furthermore, in this initially described embodiment of FIGS. 1 and 2, the guidance of the fiber sliver or mass of fiber material which is carried out by the feed passages or ducts 12 and 18 to the clamping point or nip of the feed roller or roll 14 and clamping table 15 is shorter than in the modified embodiment working with the separated, non-pivotable or stationary clamping table 15.

On the other hand, the embodiment of FIGS. 3 and 4, and the modified embodiment in accordance with FIGS. 1 and 2 characterized by elimination of the additional clamping table 20 and use of a non-pivotable or stationary clamping table 15, has the advantage that at all times an exact, constant mutual setting of the separate clamping table 15 or 25, as the case may be, is available relative to the feed roller or roll 14. In this way, the conditions for the fiber sliver feed to the opening roller 16, or equivalent structure, remain continually constant. These conditions are independent of which feed member 13 or 19 is currently or momentarily located in the operating or production position. As a result, there is ensured a constant or essentially constant thread or yarn quality. In addition, as previously mentioned, the withdrawal or retraction movement, indicated by chain-dotted lines in FIG. 1, is not necessary. This constitutes a shortening of the time required for the fiber sliver change operation and a simple mode of construction of the spinning assembly or position. In dependence upon the given circumstances, the one or the other type of constructional embodiment will be given preference.

The embodiment of FIGS. 5 and 6 again has two feed members 13 and 19 provided with feed passages or ducts 12 and 18, respectively. The feed member 13 is shown currently or momentarily located in an operating position, that is to say, in the production mode, and the other feed member 19 is thus correspondingly shown to be currently or momentarily located in a stand-by or reserve position or mode of operation. For the sake of clarity, in FIG. 5, only the fiber sliver 11 fed through the feed passage 12 has been shown although fiber slivers are again extracted or withdrawn from respective non-illustrated production and stand-by or reserve supplies and are fed into the respective feed passages 12 and 18 in the manner previously discussed. The feed member 13 shown located in the operating position is again assembled together with an associated clamping table or member 15. Also, the feed member 19 forms a rigid unit together with an associated clamping table or member, not particularly illustrated in FIG. 5 but like the depicted clamping table 15. This clamping table 15, shown momentarily located in the operating position, operates together with a feed roller 14 and in operation fiber sliver, at this time the fiber sliver 11 is fed to an opening roller 16, shown in FIG. 5 but not illustrated in FIG. 6. The feed members 13 and 19 are located on a pivotable body or body member 30.

Figure 5:
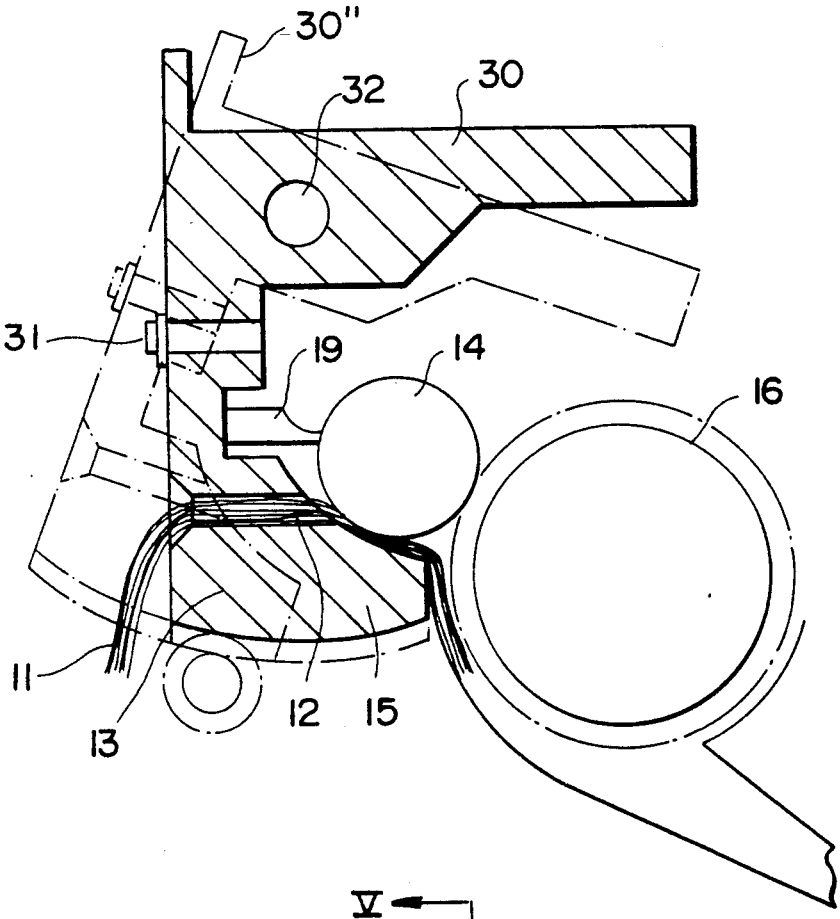
FIG. 5 is a cross-sectional view through a still further embodiment of spinning assembly or position and constructed according to the present invention, the section being taken substantially along the line V—V of FIG. 6.
Figure 6:
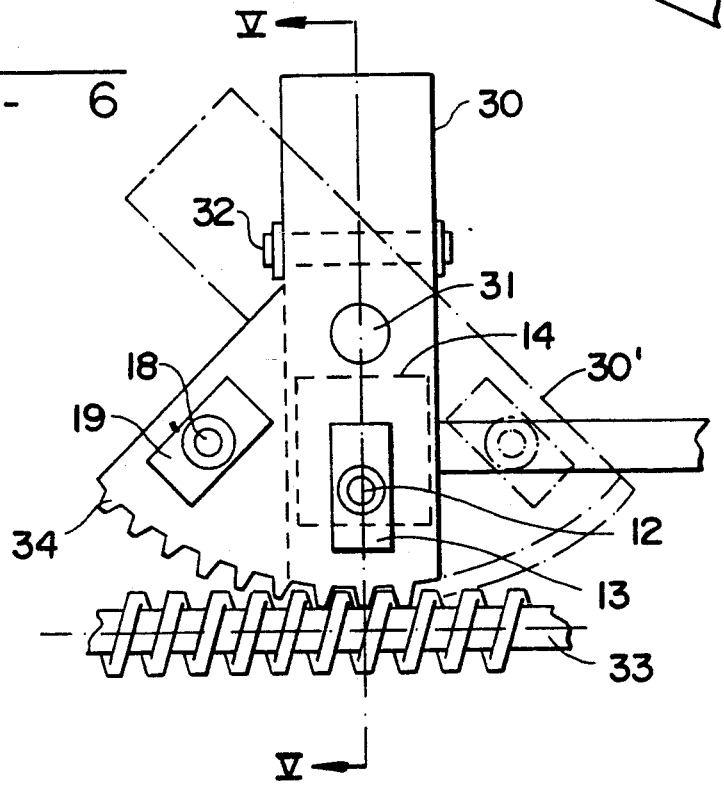
FIG. 6 is an end view of the spinning assembly or position depicted in FIG. 5 as viewed from the left side thereof.

This pivotable or pivotal body or body member 30 is pivotable about the axis of a shaft 31 into a position 30' illustrated in chain-dotted or phantom lines in FIG. 6 for the purpose of bringing the feed members 13 and 19 selectively into their operating and stand-by positions. The body or body member 30 is also pivotable together with the shaft 31 about the axis of a further shaft 32 into the position 30" illustrated in chain-dotted or phantom lines in FIG. 5. The performance of the pivotable movements carried out about the axis of the shaft 31 can be effected, for example, by means of a threaded spindle, that is, by a rotatable worm gear 33 and a pinion 34 drivable thereby. Such arrangement constitutes one possible exemplary type of drive structure for accomplishing the stated function.

In operation of the embodiment of FIGS. 5 and 6, fiber sliver is continuously moved by the feed roller 14 between itself and the associated clamping table 15 and is transported to the opening roller 16. When this feed stock or fiber sliver, which is extracted from a non-illustrated production can or supply is, for instance, used up or consumed, a signal effects pivoting of the body or body member 30 about the axis of the shaft 32 into its aforedescribed position 30" illustrated in FIG. 5. Thereupon, pivoting of the body or body member 30 is effected into its likewise aforedescribed position 30' illustrated with chain-dotted or phantom lines in FIG. 6, this being effected, as explained, by the appropriately driven worm gear 33. In this way, the feed member 19, into the feed passage or duct 18 of which there has already been threaded the start of the fiber sliver present in the stand-by or reserve supply, is moved out of its stand-by or the production position. Thereupon, the body or body member 30 is pivoted back about the axis of the shaft 32 into its original position, whereby the clamping table forming part of or associated with the feed member 19 comes into cooperation or coacting relationship with the feed roller 14. By means of this movement, the feed member 13 is now moved into the stand-by or reserve position illustrated in chain-dotted or phantom lines in FIG. 6. By virtue of the described operation, a new fiber sliver is brought into cooperation or coacting relationship with the feed roller 14.

The described change or switch-over operation requires only a modest or little amount of time so that the spinning process can be continued after a very short interruption. For exchange of the original production can or supply, which is now empty, a time period is available which is adequate for all requirements.

When the fiber sliver from the original stand-by or reserve can has been, for instance, used up, then there is again accomplished pivoting away of the body or body member 30 about the axis of the shaft 32 followed by pivoting of such body or body member 30 about the axis of the shaft 31 into the starting position illustrated in full lines in FIG. 6. These operations are followed by pivoting back the body or body member 30 about the shaft 32, whereby the feed member 13 again assumes the operating position shown in FIG. 5 in order to feed the feed roller or roll 14 with fiber sliver.

In a similar manner as described in connection with FIGS. 1 and 2, it is here also possible in this example to separate the clamping table 15 from the body or body member 30 and to locate such then now stationary clamping table 15 in continuous association with and immediately adjacent the feed roller 14. In this case, the pivotal movements carried out about the axis of the shaft 32 are no longer required.

Up until now, the use of the present invention heretofore described with reference to FIGS. 1 to 6 has been explained with respect to open-end spinning. From the subsequent description it should be apparent that when using the teachings of the present invention in a ring spinning machine, the advantages obtained are similar to those obtained in open-end spinning.

In a ring spinning arrangement in accordance with FIGS. 7 and 8, a feed member 36 is provided for a feed stock illustrated only in FIG. 7 and here formed by a mass of fiber material constituted by a roving 37. The feed member 36 is shown currently or momentarily located in its operating position. A second feed member 38 is located in its stand-by or reserve position. The feed members 36 and 38 are carried by a suitable support member or carrier plate 39. Each feed member 36 and 38 has a respective feed passage or duct 40, through which respective feed stocks or, in this case, rovings are drawn. Furthermore, drive rollers or rolls 41, 42 and 43 are provided in conjunction with pressure rollers or rolls 44, 45 and 46, each of the last-mentioned pressure rollers being appropriately biased towards a respective associated drive roll. The rollers or rolls 41 and 44 are rotatable about the axes 51 and 52, respectively, illustrated in FIG. 7. The rollers or rolls 42 and 45 serve to drive the aprons 47 of a double apron drafting mechanism or arrangement. The break drafting zone of the illustrated drafting mechanism or drafting arrangement is located between the rollers 41, 44 and 42, 45 and the main drafting zone is located between the rollers 42, 45 and 43, 46.

The rotation of a spindle 48 operating as a twisting or twist imparting member causes twisting of the fiber material emerging from the last pair of rollers 43 and 46, i.e. the generation of a yarn or thread, together with rotation of a traveller 49 around the spindle 48, and thus, with formation of a balloon 50, there is accomplished the winding of the yarn or thread onto the spindle 48. The carrier plate 39 is movable, under the action of any suitable drive, here not shown for simplifying the illustration, substantially parallel to the axes 51 and 52 together with the feed members 36 and 38, either the feed member 36 or the feed member 38 coming to rest in the operating or production position above or in coating relationship with the pressure roller 44.

In operation of the spinning assembly or position illustrated in FIGS. 7 and 8, a feed stock or mass of fiber material consisting of a fiber roving 37 is withdrawn from a schematically illustrated supply formed by a roving bobbin, generally indicated by reference character 70 in FIG. 7, and currently or momentarily constituting the production supply. The roving 37 is drawn or drafted in the drafting mechanism 41 to 47 and subsequently the formed yarn or thread is wound up on the rotating spindle 48, in a manner well known in this technology. In order to maintain brief the operating interruption caused during this spinning procedure or operation upon running out of a roving package or supply constituting the roving supply for production purposes, a procedure or mode of operation is carried out corresponding to that of the preceding described embodiments.

In the arrangement under discussion with reference to FIGS. 7 and 8, a spinning assembly or position has two roving bobbins associated therewith, the roving of the first bobbin (feed or production bobbin) being threaded into the feed member 36 currently or momentarily located in the operating position and the roving of the second bobbin (stand-by or reserve bobbin) being threaded into the feed member 38 currently or momentarily located in the stand-by or reserve position. As soon as the feed bobbin, which presently is functioning as the production feed bobbin, has been, for instance, used up, in a manner similar to the examples of FIGS. 3 and 4, after corresponding control by a signal from a suitable monitoring member, the feed member 36 is moved into the stand-by or reserve position illustrated in chain-dotted or phantom lines in FIG. 8 and simultaneously the other feed member 38 is moved into the operating or production position so that the spinning operation is taken up again fully automatically. In the event that the two feed members also operate with an additional, (non-illustrated) known type of apparatus or device for automatically piecing or joining the rovings, for example for twisting them together or splicing, it can be useful to continue the spinning operation without any interruption under the proviso that the piecing or joining operation can be carried out with sufficient care so that no thread or yarn break and no unacceptable thick or thin place arises in the thread or yarn. Thereafter, a long time interval is available to replace the now empty bobbin tube of the original feed bobbin by a full bobbin. At this point it is, however, remarked that in the description to follow, there will be considered various embodiments of piecing or joining apparatuses which can be employed for piecing or joining a reserve feed stock to a production feed stock.

As is known, in spinning machines, the space available for feed stock supplies, for instance cans or bobbins, is often available only to a limited degree. The positioning of the stand-by or reserve feed stock supplies can therefore give rise to difficulties.

An arrangement occupying only relatively very little space is obtained by an embodiment of the present invention in which a single stand-by or reserve feed stock supply is provided for each of two neighboring spinning assemblies or positions. For explanation of the mode of operation of such an embodiment, reference will be now made to FIGS. 9*a*, 9*b* and 9*c*. By referring initially to FIG. 9*a* there will be recognized a bobbin 54 associated with a first of two neighboring spinning assemblies or positions, and a bobbin 55 associated with the second of these two neighboring spinning assemblies or positions. Furthermore, a bobbin 56 shown as currently or momentarily constituting a stand-by or reserve bobbin 56 is provided. The mass of fiber material or feed stock, here in the form of a roving of the bobbin 54 is fed to a feed member 57 and the feed stock, likewise the roving of the stand-by or reserve bobbin 56 is fed to a feed member 58. The feed member 57 is shown located in the operating position, in other words, in a currently effective production mode, and the feed member 58 is shown in its currently effective stand-by or reserve position. The subsequently assumed stand-by or reserve position for the feed member 57 is indicated by reference character 59 in broken lines in FIG. 9*a*.

The second spinning assembly or position comprises feed members 60 and 61, of which the feed member 60 is currently located in its operating position and the feed member 61 in its stand-by or reserve position. The stand-by or reserve position of the feed member 60 is indicated by reference character 62 in broken lines in FIG. 9*a*. The feed stock, here the roving of the bobbin 55 is set-in or introduced into the feed member 60. In the operating phase illustrated in FIG. 9*a*, no roving is set-in or introduced into the feed member 61.

Figure 9A:
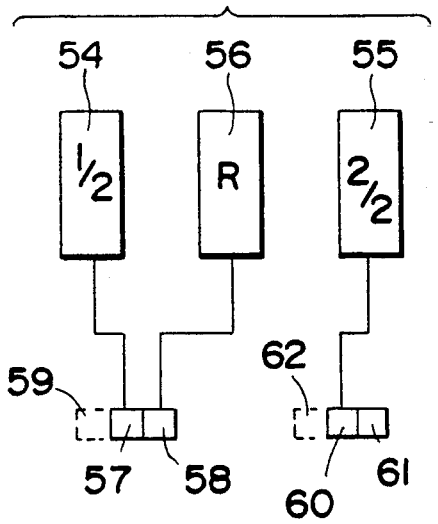
FIGS. 9*a*, 9*b* and 9*c* are schematic representations depicting two spinning assemblies or positions at various stages of operation and constructed according to the present invention, the various views serving for explanation of the mode of operation of a particular embodiment of the invention.
Figure 9B:
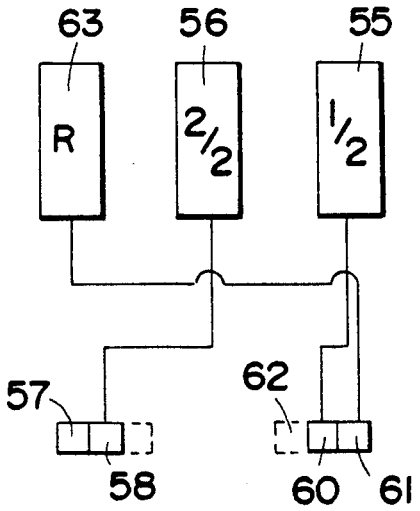
Figure 9C:
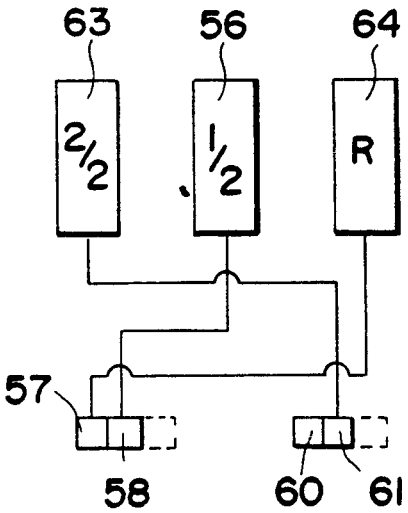

For the operation of the arrangement depicted in FIGS. 9*a*, 9*b* and 9*c*, at the start of the spinning operation, the bobbin 54 is half used up. This is indicated by the notation "1/2" in FIG. 9*a*. The bobbin 55 is fully wound with roving, as indicated by the notation "2/2". The stand-by or reserve supply or feed stock located in the stand-by or reserve position is fully wound and serves as the stand-by or reserve bobbin 56 as indicated by the reference character "R" in FIG. 9*a*.

During the spinning process, the roving strands or rovings are withdrawn from the bobbins or bobbin packages 54 and 55 currently located in the operating position, that is in the production mode. When at each of the bobbins or bobbin packages 54 and 55 half of the quantity of roving corresponding to a full package has been used up, the bobbin or bobbin package 54 is now empty. Then automatically, the first spinning assembly comprising the feed members 57 and 58 is switched off and this double feed member 57 and 58 is operated such that the feed member 57 is moved into the stand-by or reserve position 59 and the feed member 58 is moved into the operating position. This has been shown in FIG. 9*b*. After the spinning procedure or operation has been restarted, the roving is now extracted or removed from the bobbins 56 and 55.

It is here remarked that with the bobbins 54 and 55 in operation as previously described and when a quantity of roving corresponding to half of a full bobbin has been used up from these bobbins or bobbin packages 54 and 55, the bobbin or bobbin package 54 is empty and must be replaced by a full one. The full bobbin or bobbin package is indicated by reference character 63 in FIG. 9*b* and such full bobbin or bobbin package 63 now carries out the function of a stand-by or reserve bobbin or bobbin package 63. In addition, the roving of the newly inserted stand-by or reserve bobbin 63 must be threaded or introduced into the feed member 61 located in the stand-by or reserve position as shown in FIG. 9*b*. After this has been carried out, the conditions illustrated in FIG. 9*b* are established.

During further running or operation of the spinning process, the bobbin or bobbin package 55 will be eventually used up or consumed, whereupon the second spinning assembly containing the feed members 60 and 61 will be stopped and this double feed member 60 and 61 will be appropriately operated. As a result, the feed member 61, containing what was previously the stand-by or reserve feed stock, passes into the operating or production position and the feed member 60 into the stand-by or reserve position 62 (FIG. 9*b*). After the spinning process has thereafter been restarted, the now empty bobbin or bobbin package 55 must be replaced by a full bobbin or bobbin package 64 which now forms the stand-by or reserve supply, as indicated for the bobbin or bobbin package 64 of FIG. 9*c* and the roving of which this time is threaded or introduced into the feed member 57. The resulting condition or operating state is illustrated in FIG. 9*c*.

It is apparent that the newly added feed stock supply or reserve bobbin is associated, upon each exchange, with the stand-by or reserve position of that double feed member of which a production package or supply is threaded or introduced therethrough and which has a feed stock supply quantity corresponding to half of a full production package or feed stock supply.

The exchange of bobbins or bobbin packages illustrated in FIGS. 9*a*, 9*b* and 9*c* was described with reference to an illustrative example of a ring spinning machine operating with roving wound into bobbins or bobbin packages. It is mentioned in this connection that through the use of fiber supply or fiber cans filled with fiber slivers the same procedure can be adopted, wherein in this case the fiber stock supplies are constituted by cans (full, half full or empty cans) instead of bobbins or bobbin packages.

In a spinning assembly or position of a spinning machine operating in accordance with FIGS. 1 to 6, a very long time interval is available for replacement of an empty feed stock supply by a full feed stock supply, so that even where only half of this time interval is available, as in the case of the example of FIGS. 9*a*, 9*b* and 9*c* working according to a ring spinning process, there is still available a great deal of time, and thus, there is still attained an advantageous embodiment. This is so because when cans are used a large time interval is available because of their size and this is in effect equally true because even when working with bobbins or bobbin packages as the feed stock supply the comparatively slow ring spinning process is, in effect, equivalent to lengthening of the time interval throughout which replacement of the feed stock supply can be accomplished. Accordingly, the present invention has the advantage when practicing the embodiment depicted in FIGS. 9*a*, 9*b* and 9*c* of reduced spatial or space requirements for the feed stock supplies.

As already mentioned, the present invention serves in particular for automatic insertion of a new feed stock when the feed stock already in use, in other words, in the current or momentary production mode, is used up or consumed. However, the invention is also of considerable advantage in the event of a break in or rupture of the feed stock participating in the spinning process. In such case, the teachings of the present invention also permit an exchange immediately so that the feed member located in the stand-by or reserve position is moved in the illustrated and described manner into the operating or production position or mode, whereupon the spinning process can proceed, possibly after a short interruption. Hence, the positioning of the feed stock or fiber supply currently or momentarily in the stand-by or reserve position into the operating or production position, can be initiated in response to the presence of a predeterminate state or condition of the feed stock which is currently or momentarily in the operating or production position, such as, as explained, in response to depletion or near depletion of such production feed stock or even rupture thereof.

As explained previously, the invention also concerns methods and apparatus for the piecing or joining of two feed stocks to one another, specifically a production feed stock with a reserve or spare feed stock located in a stand-by or reserve position. Advantageous constructional embodiments and techniques in this regard will be now considered with reference to FIGS. 10 to 17D.

Figure 10:
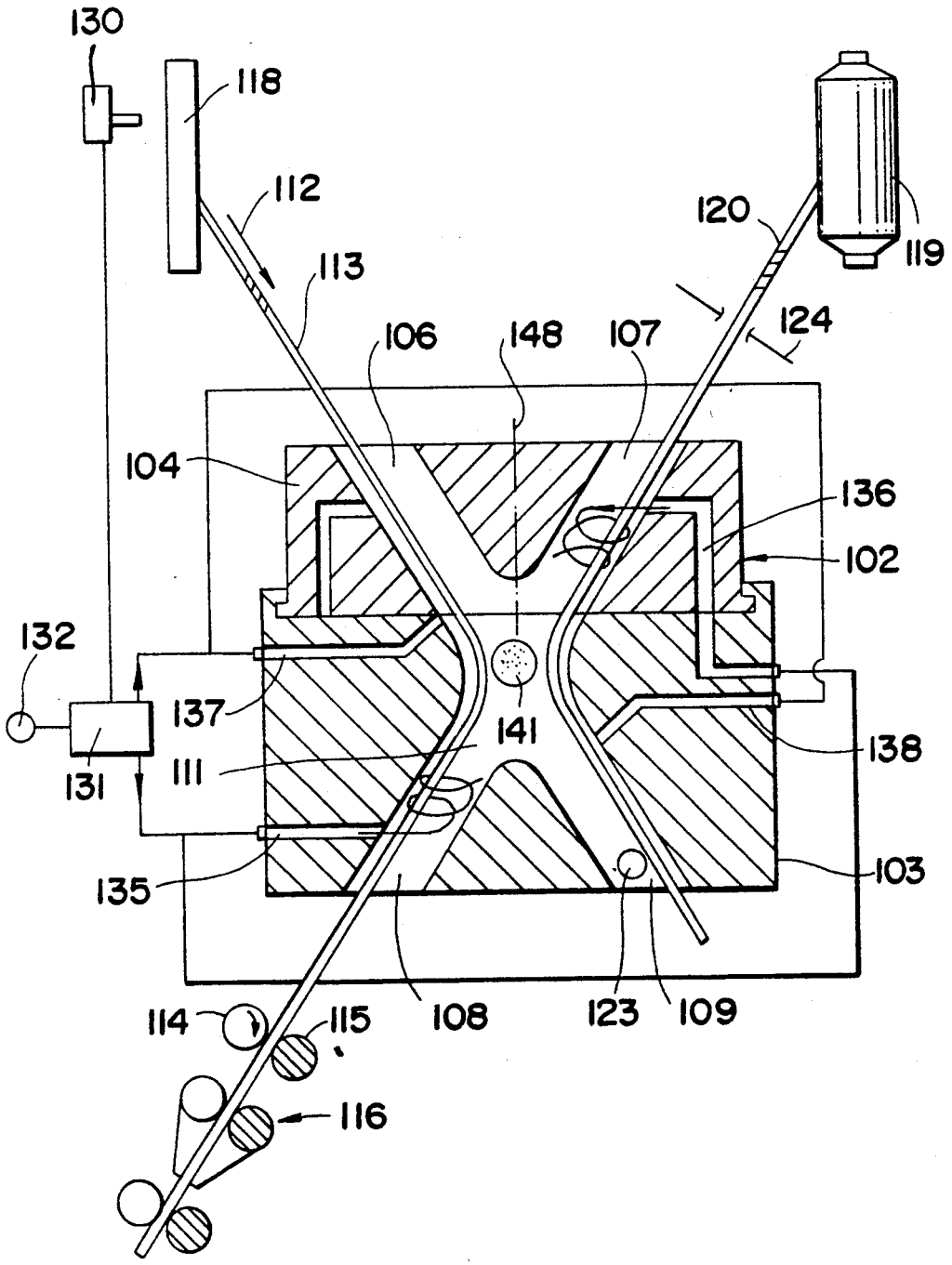
FIG. 10 schematically illustrates, partially in section, a piecing or joining apparatus or device constructed according to the present invention.

Turning now specifically to FIG. 10 of the drawings, the therein depicted piecing or joining apparatus or device will be seen to contain a block or body member 102 comprising a lower part or block or body portion 103 and an upper part or block or body portion 104 which is continuously tightly held against the lower part or block or body portion 103. In the upper part or body portion 104 there are provided channels or ducts 106 and 107 and in the lower part or body portion 103 there are provided channels or ducts 108 and 109. All of these channels 106, 107, 108 and 109 lead into an intersection zone or region 111 provided in the lower part or body portion 103, thus connecting or communicating all of these channels 106, 107, 108 and 109 with one another.

A production feed stock, here a production roving 113 (meaning that such roving is currently in the production or operating position), moves in the direction of the arrow 112 and has, for instance, Z-twist. This production roving 113 is removed from a production bobbin or bobbin package 118 by means of infeed or delivery drafting rolls or cylinders 114 and 115 of a drafting mechanism or arrangement 116. This production roving 113 thus moves through the intake channel 106 for the current production roving 113 and then through the exit or outlet channel 108 for such production roving 113. This constitutes the operating position.

A reserve or spare or stand-by feed stock, here a reserve or spare roving 120, also having, for instance, a Z-twist, is spooled off the reserve or spare bobbin 119 and is manually or mechanically inserted into the intake channel 107 for the current reserve or spare roving 120 and further into the exit or outlet channel 109 for such reserve or spare roving 120 until the end of this reserve or spare roving 120 is just visible from the block or body member 102. This constitutes the stand-by or reserve position.

An air suction nozzle 123 or the like in the exit or outlet channel 109, which keeps the reserve or spare roving 120 taut or tensioned, may be provided but is, however, not absolutely necessary since the depending reserve or spare roving 120 also remains stationary without the provision of the air suction nozzle 123. A roving gripping means or gripper 124 or equivalent facility which is here provided and arranged in front of the intake channel 107 could also be omitted.

A monitoring means or member 130, for example an optical sensor, monitors the current production bobbin or bobbin package 118 and when, for instance, a minimum roving supply is reached on the bobbin or bobbin package 118, the monitoring means or member 130 emits a signal to an air inlet valve or air infeed control 131 or equivalent structure. This air inlet valve 131, in turn, initially conducts or supplies air from a suitable air source or supply 132 simultaneously into an air duct or passage 135 in the exit or outlet channel 108 and into an air duct or passage 136 in the intake channel 107. These air ducts 135 and 136 are here shown to enter, for instance, tangentially into the respective, oppositely arranged channels 108 and 107, so that the supplied air imparts onto a first roving section or portion 113.1 of the current production roving 113 and onto a first roving section 120.1 of the current reserve or spare roving 120, an increasing twisting force or twist (see also FIGS. 11 and 12).

In the depicted illustration, the air ducts or channels 135 and 136 run askew to the lengthwise axes of the channels 107 and 108, however, they can also run normal or perpendicular thereto. By increasing the twist of the first roving sections or portions 113.1 and 120.1, as previously described, a twist decrease automatically occurs in a second adjacent roving section or portion 113.2 of the production roving 113 and the second adjacent roving section or portion 120.2 of the reserve or spare roving 120 (see FIGS. 11 and 12). As soon as the fibers within these second roving sections or portions 113.2 and 120.2 run or extend essentially parallel to one another, which at the latest happens several seconds after the air supply into the air ducts 135 and 136, then the time-delay operated air inlet valve 131 simultaneously conducts or infeeds, by means of an air blast, air into an air duct or passage 137 leading to the intake channel 106 and into an air duct or passage 138 leading into the opposite channel 109 for the purpose of separation or severing the rovings 113 and 120.

Figure 11:
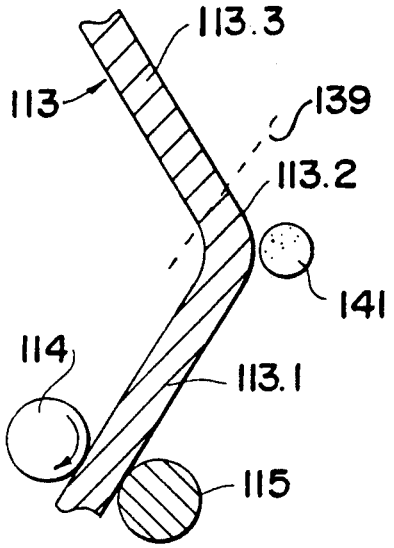
FIGS. 11 to 14 respectively illustrate on an enlarged scale fiber stock portions or parts, here for instance roving portions or sections, during various stages of processing in the piecing or joining apparatus depicted in FIG. 10 in order to explain and clarify various method steps accomplished during the piecing or joining operation.

The air from the air ducts 137 and 138 strike or impinge upon the rovings 113 and 120 within the second roving sections or portions 113.2 and 120.2, respectively, askew or at a sharp angle according to the dashed line 139 shown in FIG. 11, thereby blowing the superfluous separated roving part or portion 113.3 of the current production roving 113 upwards out of the related intake channel 106 and at the same time forming a tuft or fiber beard or barb or the like on the free end of this second roving section or portion 113.2. Similarly, the separated, superfluous roving part or portion 120.3 of the current spare or reserve roving 120 is blown downwards, also forming a tuft or fiber beard or barb or the like on the free end of this second roving section or portion 120.2. This superfluous roving part or portion 120.3 is drawn into the air suction nozzle 123 (FIG. 10). Only now the air supply to the air ducts 135 and 136 is suddenly interrupted. In order for this air to escape even faster there is provided a closable, perforated air exit or discharge 141 in the intersection zone or region 111 which opens at the appropriate moment. During the increasing of the twist and the severing or separation of the rovings, the moving production roving 113 is held taut or tensioned by the bobbin 118 and the drafting mechanism or arrangement 116. The gripping means 124 and the air suction nozzle 123, if chosen to be provided, would help to obtain slightly better results. The gripping means 124 also serves to limit the distance or extent of application of the increased twist of the reserve or spare roving 120.

Figure 12:
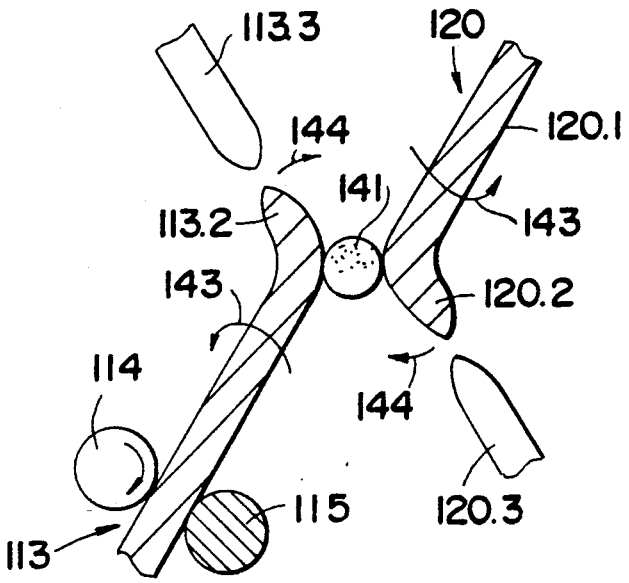
Figure 13:
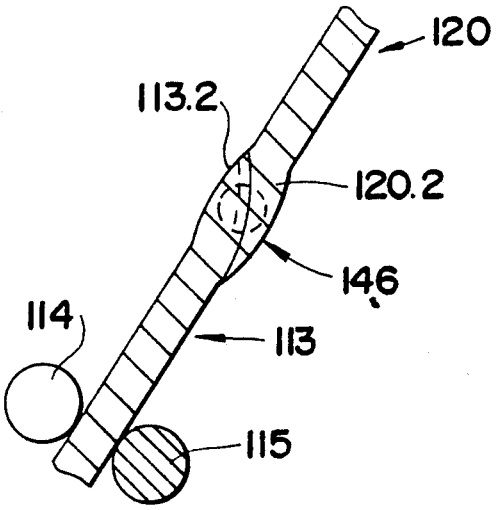
Figure 14:
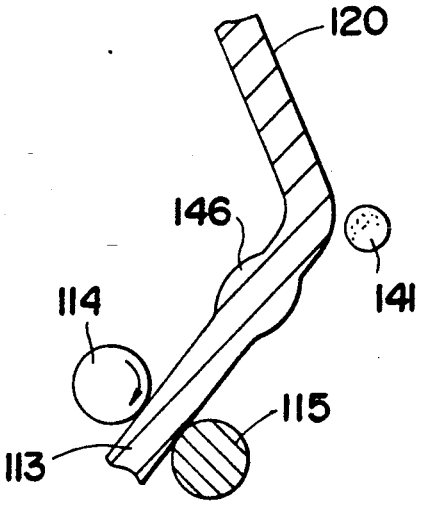

As soon as the increasing twisting force or twist is removed, then the roving end sections or portions 113.1 and 113.2 as well as the roving end sections or portions 120.1 and 120.2, due to the imparted torsional spring action, will decrease the twist and axially rotate according to the arrow 143, shown in FIG. 12. As a result of this rotational movement also the bent second roving sections or portions 113.2 and 120.2 will straighten themselves according to the arrow 144. With proper dimensioning of the intersection zone or region 111, the proper location of the channels 106, 107, 108 and 109 and the axial movement of the production roving 113, these roving end sections or portions 113.2 and 120.2 are brought together and are joined or fused by impact and swirling (FIG. 13).

Good results were obtained by utilizing channels 106, 107, 108 and 109 all having a uniform and identical diameter, which diameter was two to three times the diameter of the roving, for example, 5 to 8 mm. The air pressure used was 4 bar. The tensile strength of the thus formed joint or fusion 146 need not be optimal, since it suffices when the reserve or spare roving 120 is taken in by the drafting mechanism or arrangement 116 and when it withstands the forces in the balloon. Also, an increase in thickness of the joint or fusion 146 is not considered a disadvantage with ring spinning machines, since these thicker sections will be cut out automatically in the spooler.

After piecing or joining the rovings 113 and 120, the upper part or body portion 104 is moved, here rotated or turned about an axis 148, normal or perpendicular to the lower part or body portion 103, so that the intake channel 107 for what was previously the reserve or spare roving now becomes the intake channel 106 for what now becomes the production roving. In this way, by virtue of such rotational movement, the reserve or spare roving 120 is brought into the operating or production position, which was previously defined by the coacting channels 106 and 108 (FIG. 10). A block or body member 102 is provided at each spinning unit or position of the ring spinning machine.

At this juncture there will be now considered the piecing or joining apparatus or device of the embodiment depicted in FIGS. 15A to 17D. It will be specifically understood that in the showing of FIG. 15A there is depicted a piecing or joining apparatus employing a purely mechanical mode of operation. A housing 202, preferably secured to the drafting mechanism or to the traverse rod, is arranged directly forwardly or in front of a pair of infeed or delivery rolls 203 of the drafting mechanism. As will be recognized from FIG. 16A, this housing 202 has an open-ended or continuous elongate hole or opening 204 and at one lengthwise side of the housing 202 an open slot 205. This open slot 205 merges or opens into the elongate hole or opening 204 and extends over the entire length of the elongate hole 204.

The upper smooth rounded end or portion 206 of the elongate hole or opening 204 determines or bounds the path of the production roving 208 in upward direction. This production roving 208 extends in quite conventional fashion from the pair of infeed or delivery rolls or rollers 203 to a production feed stock or roving bobbin 209. At the lower region of the elongate hole 204 there is arranged a movable member in the form of a slide or sliding plate 212 which can displace or move essentially at right angles or perpendicular to the upper end or portion 206 of the elongate hole or opening 204. Reference character 214 designates a contact or press-on or pressing region of the housing and which is located opposite the pair of infeed or delivery rolls 203. At such pressing or press-on region 214 there extends in substantially parallel orientation the linear upper narrow side or edge 215 of the slide plate or plate member 212 and the upper end or portion 206 of the elongate hole 204. At the part of the housing 202 which faces away from the pair of infeed or delivery rolls 203 there is provided a clamping region, generally designated by reference numeral 217. At the clamping region 217 a clamping body or member 219 is laterally secured to the slide or sliding plate 212.

Figures 15A, 15B:
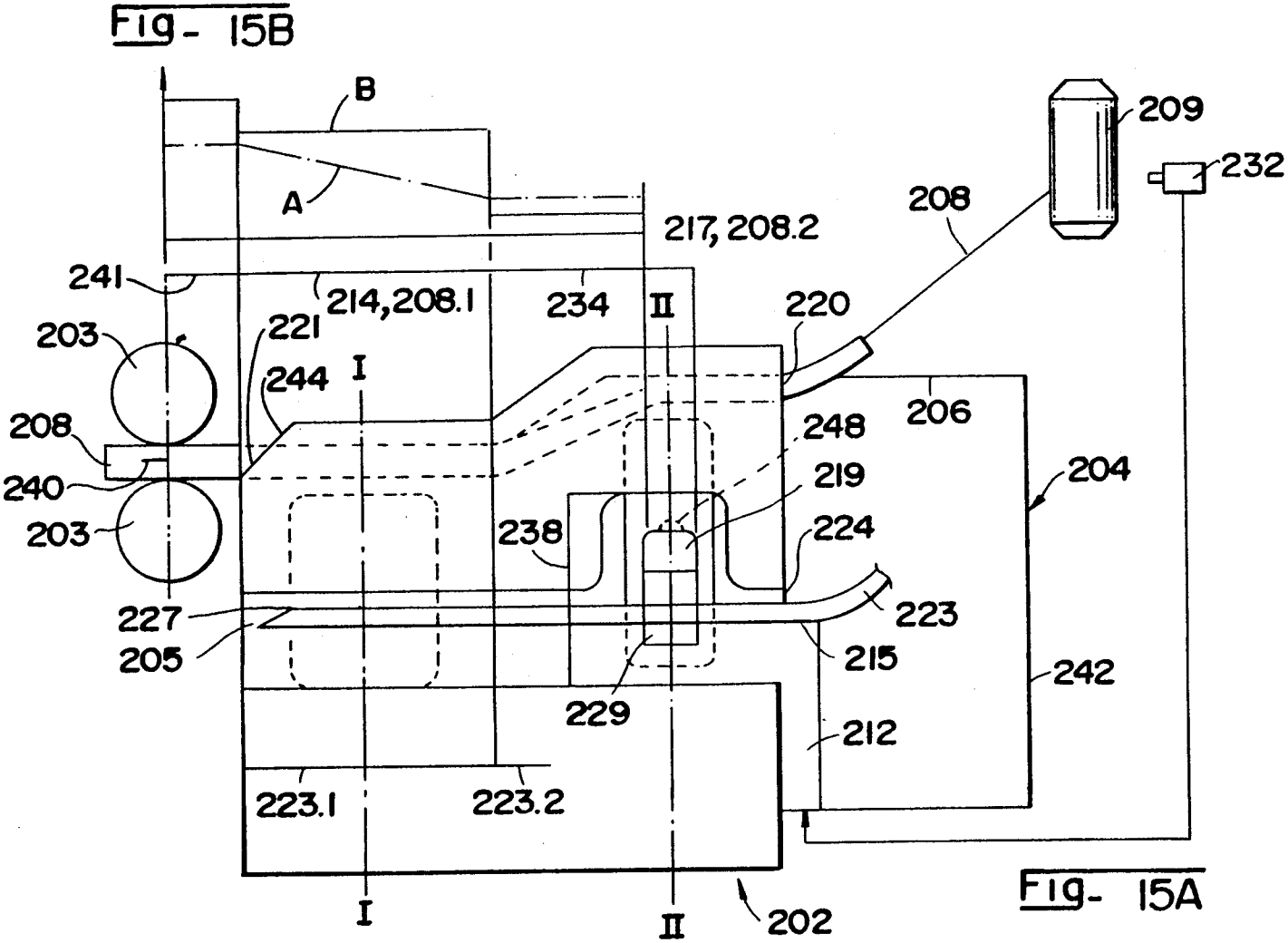
FIG. 15A is a longitudinal side view of a further exemplary embodiment of piecing or joining apparatus or device for joining or piecing a reserve or spare feed stock, here a reserve or spare roving, to a production feed stock, here a production roving, and constructed according to the present invention.
FIG. 15B is a graphic illustration of the tension strength values of the roving and the tension forces applied to the roving at different regions of the joining or piecing apparatus or device depicted in FIG. 15A.
Figure 16A:
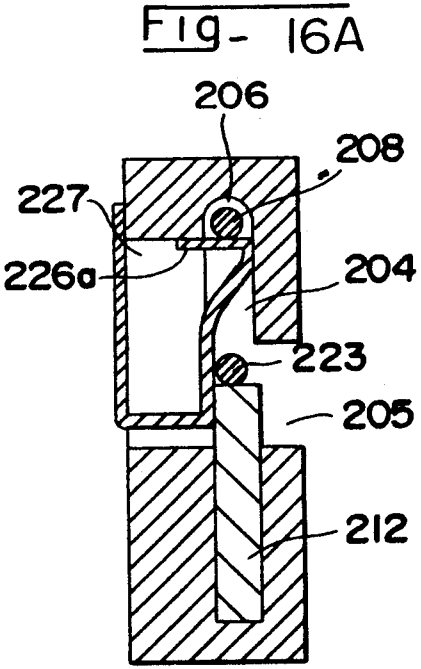
Figure 17D:
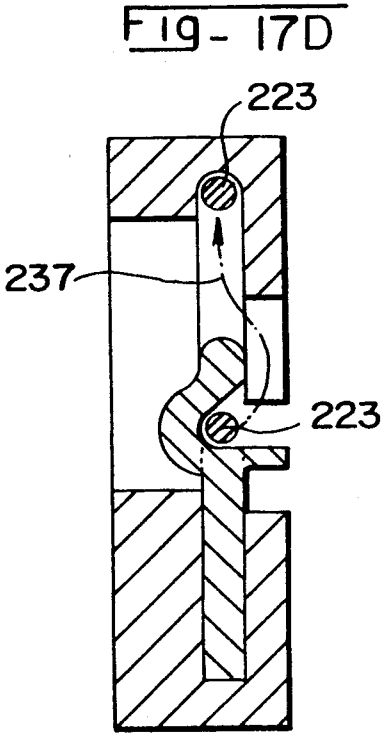
FIGS. 17A, 17B, 17C and 17D, like FIGS. 16A, 16B, 16C and 16D, illustrate part of the piecing or joining apparatus of FIG. 15A, but this time in section taken substantially along the line II—II of such FIG. 15A and again variously showing different steps in the piecing or joining operation accomplished with the piecing or joining apparatus or device of FIG. 15A.

During such time that a production roving 208 is withdrawn by means of the pair of infeed or delivery rolls 203 from the feed stock bobbin 209, here a roving bobbin, and passes in the operating portion of the housing 202 from its production roving infeed location 220 to its production roving outfeed location 221, a reserve or spare feed stock 223, here a roving, is manually placed or with the aid of a gripper of a servicing unit by parallel displacement through the lengthwise slot 205 upon the upper narrow edge or side 215 of the slide plate 212. Of course, the not particularly illustrated gripper, also can pull the reserve or spare roving 223 from a reserve or spare roving infeed location 224 through the length of the housing 202 by performing an axial movement. In FIGS. 15A, 16A and 17A there has been illustrated the fiber stock infeed position.

In the contact or pressing or press-on region, a spacer or distance element, here, for instance, a removable blade or leaf spring 226, is arranged in a recess or opening 227 and secured at the housing 202. This blade spring 226 bridges the width 228 of the elongate hole 204 and determines or limits by means of its flat part or portion 226*a* the path of the production roving 208 in downward direction. At the same time the production roving 208 and the reserve or spare roving 223 are held in spaced relationship from one another. Also, at the clamping region 217 the reserve or spare roving 223 reposes upon the upper narrow side or edge 215 of the slide plate or plate member 212. The reserve or spare roving 223 is located in a bowed-out or bulging portion or recess 219*a* of the clamping body or body member 219.

A further somewhat less suitable construction contemplates retaining the reserve or spare roving 223 throughout the length, that is to say, in the lengthwise direction of the housing 202, of the clamping body 219 upon a protruding flap or tab portion 229 and connecting the clamping body 219 without any bowed-out or bulging portion directly with the upper narrow side or edge 215 of the slide plate or plate member 212.

However, what has been depicted is a clamping body or body member 219 having a bowed-out or bulging portion and in the arrangement shown the reference numeral 229 constitutes a stop or impact member which is not absolutely required and thus optional. FIGS. 16B and 17B depict the stand-by or preparatory position of the reserve or spare roving 223, and the slide plate 212 has been raised or displaced in such a manner that at the pressing or press-on region 214 this slide plate 212 bridges the lengthwise or longitudinal slot 205. As a result, an end region or portion or section 223.1 of the reserve or spare roving 223 is fixedly retained between the upper narrow side or edge 215, the blade spring 226 throughout the length thereof and the housing portion located above the lengthwise slot 205.

Figure 16D:
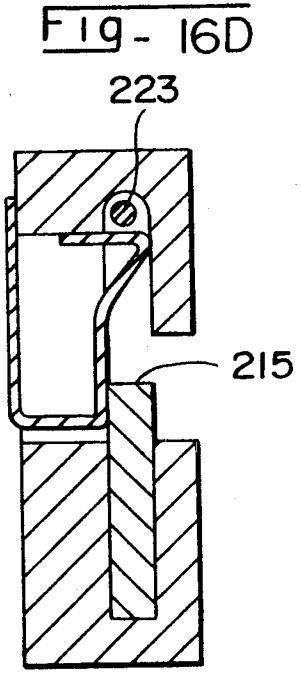
FIGS. 16A, 16B, 16C and 16D illustrate part of the piecing or joining apparatus of FIG. 15A in section taken substantially along the line I—I thereof and variously showing different steps in the piecing or joining operation accomplished with the piecing or joining apparatus or device of FIG. 15A.
Figure 16C:
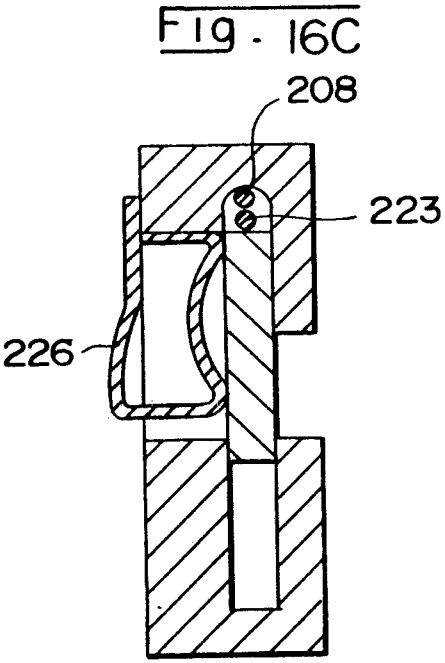
Figure 16B:
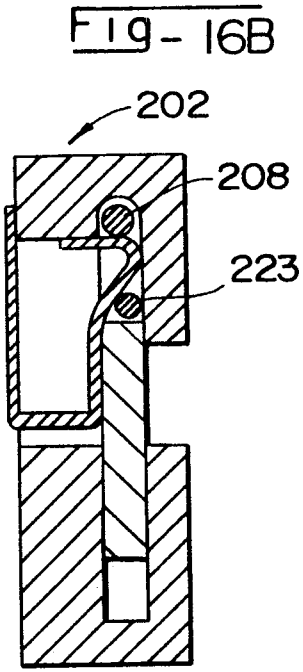
Figure 17C:
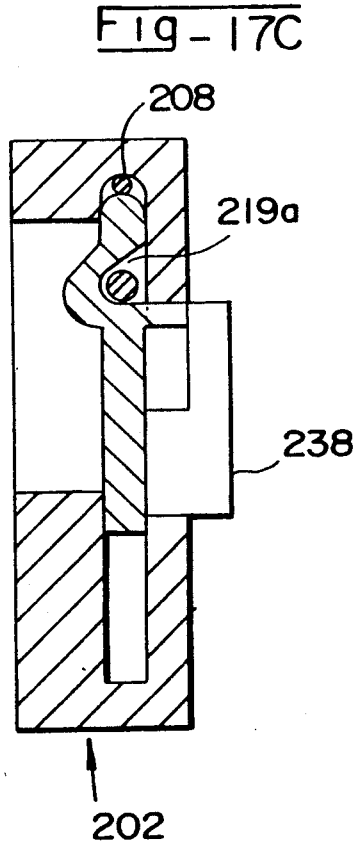
Figure 17B:
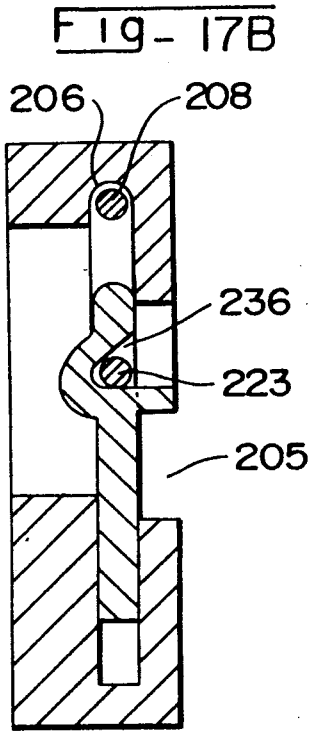
Figure 17A:
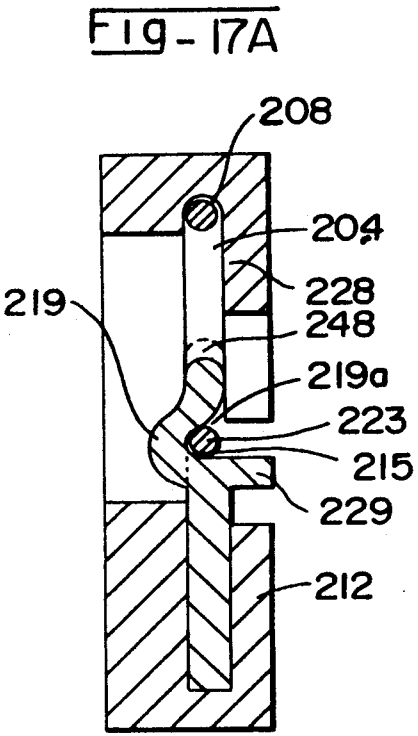

Now whenever a monitoring device or means 232, for instance an optical sensor, determines a minimum quantity of feed stock or roving present at the production feed stock or roving bobbin 209, then the slide plate or plate member 212 is activated, so that it is brought into the so-called connection or coupling position (FIGS. 16C and 17C). As a result, the slide plate 212 displaces the blade or leaf spring 226 out of the width extent 228 of the elongate hole 204, in other words presses such blade spring 226 to the other side, and the end portion or section 223.1 of the reserve or spare roving 223 is brought into the path of the production roving 208. This end portion or section 223.1 of the reserve or spare roving 223 is pressed against a first portion or section 208.1 of the production roving 208 in such a manner that the reserve or spare roving 223 adheres to the travelling production roving 208.

Consequently, the reserve or spare roving 223 is entrained by the travelling roving 208 and is drawn-in by the pair of infeed or delivery rolls 203. There is tolerated the formed thickened portion at the piecing or joining location of both rovings 208 and 223. At the same time, the clamping body or body member 219 is displaced by the movable or slide plate 212 in the direction of the upper end or region 206 in such a manner that a second section or portion 208.2 of the production roving 208 is clamped between the clamping body 219 and the upper end or portion 206 of the elongate hole or opening 204 and thus retained. The spacing or distance 234 between the pressing or press-on region 214 and the clamping region or zone 217 constitutes a reference fracture or expected breaking region and within this spacing or distance 234 the production roving 208 ruptures or separates. On the other hand, the reserve or spare roving 223 is entrained by the pair of infeed or delivery rolls 203 and now becomes the new production roving.

After a required period of time has elapsed the slide plate 212 is again brought into its starting position corresponding to the infeed position depicted in FIGS. 16A and 17A. A second section or portion 223.2 of the reserve or spare roving 223, which bounds or neighbors the end section or portion 223.1 of the reserve or spare roving 223, is drawn into the original travel path of the prior production roving 208 and against the upper end or portion 206 of the elongate hole or opening 204 (FIG. 17D). This is accomplished by virtue of the pair of infeed or delivery rolls 203 drawing taut the reserve or spare roving located between the pair of infeed or delivery rolls 203 and the not illustrated stand-by or reserve feed stock or roving bobbin and which now has become or forms the new production roving. This drawing taut or tensioning of the reserve or spare roving moves such over an inclined portion 236 into the recess 219*a* at the clamping body 219 according to the arrow 237 so that it moves into the original travel path of the prior production roving 208 and against the upper end 206 of the elongate hole 204 as above explained. In order that the automatic drawing taut or tensioning can be accomplished at the production roving infeed location 220, the lengthwise slot 205 has a greater depth 238 throughout a length thereof overlapping the clamping region or zone 217.

In order to increase the functional reliability of the method and to ensure that the roving will rupture or separate without doubt within the distance or spacing 234, in other words, the reference or expected break region or zone 234, there should be preferably provided additional measures which will be explained in conjunction with the illustration of FIG. 15B. This FIG. 15B graphically portrays the course or pattern of the chain-dot depicted tension or tensile force A exerted upon the roving and the tensile strength B of the roving which is plotted along the ordinate as a function of the distance or spacing between the clamping point 240 of the pair of infeed or delivery rolls 203 and the clamping region 217 and which is plotted along the abscissa. The greatest relative tensile strength can be imparted to the roving throughout the distance or spacing 241 between the clamping point 240 of the pair of infeed or delivery rolls 203 and the pressing or press-on region 214 in that this distance 241 is chosen to be smaller than one-half of the mean or average fiber length, preferably being as small as possible. If the roving should sever or tear at this location, then most of the individual fibers must be torn or broken.

Due to the pressing of the reserve or spare roving 223 against the production roving 208 in the pressing or press-on region 214, the tensile strength B of both rovings is increased, but reduced to a greater extent by virtue of the larger distance in comparison with the distance or spacing 241. Due to the friction between the rovings 208 and 223 and the housing components, the tension or tensile force A at the roving linearly decreases. Through the performance of simple trials or experiments, there can be determined suitable coefficients of friction through selection of the material to be employed and the surface properties. The reference fracture or expected break region or zone 234 between the pressing or press-on region 214 and the clamping region 217 should have a distance or spacing which is greater than the mean or average fiber length. Consequently, the individual fibers, which now no longer are pressed against one another, need not be torn rather can slide upon one another.

At the reference fracture or expected break region or zone 234, the value of the tensile strength B of the roving 208 is below the value of the tensile force A at the roving 208. At the distance or spacing or expected break region 234, the roving 208 should move with as little contact as possible with the upper end or portion 206 of the elongate hole or opening 204, that is to say, should move in a free travel path or space, so that uncertainties otherwise arising because of such contact are avoided. It is for this reason that the elongate hole, at least at the spacing region 234, possesses a greater depth or height 242. With the embodiment depicted in FIG. 15A, this enlarged depth 242 extends up to the region of the production roving infeed location 220.

In order to be able to position the housing 202 as close as possible to the pair of infeed or delivery rolls 203, this housing 202 can be arranged to be upwardly pivotable or tiltable in such a fashion that both rolls of the pair of infeed or delivery rolls 203 possess approximately the same spacing to an inclined or bevelled surface 244 at the production roving outfeed or outlet location 221.

A notable advantage of rupture or breaking of the roving as a consequence of an indirect separation or severing at the reference fracture or expected break region or zone 234 resides in the fact that there occurs the formation of a fiber tuft or beard at the separated parts of the production roving 208, so that the joining or connection location exhibits a gradually thickened or enlarged portion. Experiments have shown that between the drafting mechanism and the spindle, there do not arise thread breaks if the rotational speed of the spindle is briefly lowered to 12,000 rpm.

A further possibility of separating or severing the production roving 208 resides in arranging at the upper end of the clamping body or body member 219 a severing means or facility, for instance a knife or cutter 248, which has only been shown in broken lines in FIGS. 15A and 17A. The reference numerals 219 and 248 collectively designate a separation or severing body. The severing operation, that is to say a direct separation or severing is simultaneously accomplished with the contact or pressing-on operation, but however could occur somewhat sooner. The distance or spacing 234, in this case, can be reduced towards null, so that the separation or severing region 234, 217 practically reduces to the region 217. Experiments with this type of separation or severing, however, require a reduction of the spindle rotational speed to about 2,000 rpm, which is attributable to the non-presence of a fiber beard and, consequently, with the sudden thickness reduction of the joining or connection location.

A further possibility of separating the production roving 208 in a direct manner, resides in the features that, instead of using a knife or cutter 248, there is employed a drivable milling device or rasp or equivalent structure as the separation or severing means or facility. Such is employed for the purpose of producing a fiber tuft or beard by accomplishing a shearing-through or grinding action. Such a piecing or joining apparatus becomes somewhat more complicated in its design since here there also must be possibly provided a fly or contaminant suction removal device.

Instead of using a mechanical clamping of the production roving 208 it would be conceivable to perform the clamping operation pneumatically. What would be required in this case, is an air channel opening into the elongate hole 204 and extending through the upper narrow side or edge of the housing 202 in the clamping region or zone 217. The production roving 208 can then be held or clamped by a clamping body containing or equipped with a suction air nozzle or equivalent structure.

Naturally, it is possible to allow the production roving 208 to simply run-out or finish by itself, i.e. without separating or severing the same. The finishing or terminal end of the production roving then has to be monitored for its location or locality by means of a suitable monitoring means or device, like the monitoring means or device 232 of FIG. 15A, for example, an optical sensor. This optical sensor should be suitably placed at a defined position upstream of the piecing or joining apparatus or device. Such optical sensor emits a signal in dependence upon which the movable or slide plate 212 moves in upward direction. Since the velocity of movement of the running production roving is known as is also the distance between the monitoring location or monitoring device, in other words, the detected terminal or finishing end of the depleted or depleted production roving and the piecing apparatus or any desired predeterminate reference point thereof, and since there is likewise known the velocity of movement of the movable or slide plate 212 carrying the reserve roving and the distance through which such movable or slide plate 212 must move in order to bring the reserve roving 223 into contact or pressed-on relationship with respect to the depleted production roving 208, it is possible to exactly calculate a predeterminate length of the terminal end portion or section of the depleted production roving 208 with which the reserve roving 223 is to be brought into such press-on contact. In this case, the entire length of the reserve roving 223 located within the piecing or joining apparatus can be moved in its entirety into the path of travel of the production roving 208. With this technique it will be recognized that, as noted above, it is unnecessary to undertake separation of the production roving as heretofore described and which was there accomplished by a clamping action or cutting action or the like.

While there are shown and described present preferred embodiments of the invention, it is to be distinctly understood that the invention is not limited thereto, but may be otherwise variously embodied and practiced within the scope of the following claims. ACCORDINGLY,

What we claim is:

1. A spinning machine producing yarns from drawable staple fiber feed stock in which feed stock passes from a feed stock supply to at least one spinning assembly, comprising:

a production feed stock at least temporarily provided for the at least one spinning assembly;

a stand-by feed stock at least temporarily provided for the at least one spinning assembly;

a feed member for feeding the production feed stock to the at least one spinning assembly;

a feed member for feeding the stand-by feed stock to the spinning assembly when the production feed stock has attained a predeterminate state;

the feed member feeding the production feed stock being located in an operating position and the feed member serving for feed of the stand-by feed stock being located in a stand-by position; and means for changing the feed members between the operating and stand-by positions in dependence upon the predeterminate state of the production feed stock delivered to the feed member located in the operating position.

2. The spinning machine as defined in claim 1, wherein:

said two feed members comprise a common substantially linearly movable body; and said feed members, during course of movement of said substantially linearly movable feed body, alternately moving into an operating position and a respective one of two stand-by positions.

3. The spinning machine as defined in claim 1, further including:

a body common to both of said feed members;

said feed members being mounted upon said body common to both of said feed members;

a shaft having an axis;

said changing means serving for pivoting said feed members about the axis of the shaft; and said feed members being alternately pivotable into the operating position and stand-by position by pivoting of said body about the axis of the shaft.

4. The spinning machine as defined in claim 3, further including:

a feed roll;

a member cooperating with said feed roll to define therewith a converging space;

each of said feed members having a feed passage for the movement therethrough of feed stock;

each of said feed passages having an exit portion;

the exit portion of the feed passage of the feed member momentarily located in the operating position being disposed in front of said converging space; and said changing means including means for moving the body for adjusting the spacing between the feed member located in the operating position and the feed roll.

5. The spinning machine as defined in claim 1, wherein:

said at least one spinning assembly comprises two said spinning assemblies;

each of said spinning assemblies having an associated production feed stock;

a respective pair of said feed members provided for each spinning assembly;

said stand-by feed stock comprises a single stand-by feed stock supply provided for said two spinning assemblies;

the single stand-by feed stock supply being positioned in the stand-by position, upon start of a spinning operation after a change of the feed stock supply, for that pair of feed members to which there is connected a production feed stock supply which in quantity is substantially equal to half of the quantity of the single stand-by feed stock supply; and a production supply for the production feed stock associated with a feed member of the other pair of feed members located in the operating position being substantially equal in quantity to the quantity of the single stand-by feed stock supply.

6. The combination of a spinning machine for producing yarns from drawable staple fiber feed stock at least at one spinning position and feed stock feeding means, comprising:

a current production feed stock provided at least temporarily for the at least one spinning position;

a current stand-by feed stock provided at least temporarily for the at least one spinning position;

a feed member for furnishing the current production feed stock to the at least one spinning position;

a feed member for furnishing the current stand-by feed stock to the at least one spinning position when the current production feed stock has attained a predeterminate state;

the feed member furnishing the current production feed stock being located in an operating position and the feed member for furnishing the current stand-by feed stock being located in a stand-by position; and means for selectively positioning the feed members at the operating and stand-by positions in dependence upon the predeterminate state of the current production feed stock.

7. The combination as defined in claim 6, wherein:

said feed member for furnishing the stand-by feed stock to the at least one spinning position feeds the current stand-by feed stock when the current production feed stock is at least nearing a state of depletion and which near state of depletion constitutes said predeterminate state of the current production feed stock.

8. A process for the automatic starting of a staple fiber silver on an open end spinning device equipped with a feeding device, a first guide being in a feeding position relative to the feeding device and feeding the staple sliver to the feeding device, a second guide maintaining a second fiber sliver in a readiness position relative to the feeding device, means for monitoring the presence of a staple fiber in the first guide and a device for emitting a signal responsive to the monitoring means for starting feeding of the second fiber sliver to the feeding device, the process comprising the following steps:

(a) inserting a first staple fiber sliver into the first guide;

(b) positioning the first guide at the feeding position relative to the feeding device;

(c) feeding the first sliver into the feeding device;

(d) positioning the second guide at its readiness position relative to the feeding device;

(e) inserting a second staple fiber sliver into the second guide;

(f) moving the first guide from the feeding position to the readiness position when the feeding of the first staple fiber sliver to the feeding device is interrupted;

(g) moving the second guide to the feeding position simultaneously as the first guide is moving away from the feeding position upon interruption of the feeding of the first staple fiber sliver to the feeding device;

(h) feeding the beginning of the second staple fiber sliver to the open-end spinning device;

(i) taking the beginning of the second staple fiber sliver out of the open end spinning device; and (j) effecting piecing.

9. A process for the automatic starting of a staple fiber sliver on a textile machine equipped with a drawing frame with several sliver feeding positions, with at least one feeding device, at least one feeding device having a first guide being in a feeding position relative to the feeding device and feeding the staple fiber sliver to the feeding device, the at least one feeding device further having a second guide maintaining a second fiber sliver in a readiness position relative to the feeding device, means for monitoring the presence of a staple fiber in the first guide, and a device for emitting a signal responsive to the monitoring means for starting feeding of the second fiber sliver to at least one feeding device, this being assigned jointly to several sliver feeding positions, the process comprising the following steps:

(a) inserting a first sliver into a first guide;
(b) inserting a second sliver into the second guide;
(c) positioning the first guide at a feeding position relative to the feeding device;
(d) feeding the first sliver into the feeding device;
(e) positioning the second guide at a readiness position relative to the feeding device;
(f) monitoring the first guide for the presence of the first staple fiber sliver;
(g) moving the first guide from its feeding position into its readiness position when the feeding of the first staple fiber sliver to the feeding device is interrupted;
(h) moving the second guide into the feeding position as the first guide is moving away from the feeding position upon interruption of the feeding of the first staple fiber sliver to the feeding device; and
(i) feeding the second sliver into the feeding device.

10. A feeding apparatus for fiber feed stock of a textile machine, comprising:

means for feeding fiber material to a textile machine;

said means for feeding fiber material comprising:

a plurality of feeding positions for feeding fiber feed stock;

means for defining a plurality of fiber feed stock supplies, including a single reserve fiber feed stock supply for at least two feeding positions of said plurality of feeding positions;

said at least two feeding positions being provided for feeding fiber material from respective ones of said plurality of fiber feed stock supplies and from said single reserve fiber feed stock supply for said at least two feeding positions; and means for selectively switching, at either of said at least two feeding positions, from one of said plurality of fiber feed stock supplies to said single reserve fiber feed stock supply.

11. The feeding apparatus as defined in claim 10, means for sensing a predeterminate state of operation of each respective fiber feed supply, wherein said selective switching means selectively switches from a respective fiber feed stock supply to said single reserve fiber feed stock supply in response to sensing of said predeterminate state of operation.

12. The feeding apparatus as defined in claim 11, wherein said predeterminate state of operation comprises depletion or near-depletion of fiber feed stock.

* * * * *